United States Patent [19]

Riehl

[11] 3,961,472

[45] June 8, 1976

[54] SOLID STATE ELECTRONIC TIMEPIECE

[75] Inventor: Roger W. Riehl, Troy, Ohio

[73] Assignee: Ragen Semiconductor, Inc., Whippany, N.J.

[22] Filed: July 10, 1974

[21] Appl. No.: 486,990

Related U.S. Application Data

[62] Division of Ser. No. 139,468, May 3, 1971, Pat. No. 3,823,551.

[52] U.S. Cl. ..... 58/4 A; 58/50 R; 58/55; 58/58.5; 58/85.5; 58/90 R

[51] Int. Cl.[2] ..... G04B 19/24; G04B 37/08

[58] Field of Search ..... 58/4 A, 50 R, 55, 58, 58/85.5, 90 R

[56] References Cited

UNITED STATES PATENTS

| | | | |
|---|---|---|---|
| 3,328,954 | 7/1967 | Miller | 58/23 |
| 3,672,155 | 6/1972 | Bergey et al. | 58/50 R |
| 3,782,102 | 1/1974 | Bergey | 58/85.5 |

*Primary Examiner*—Edith Simmons Jackmon
*Attorney, Agent, or Firm*—Jacox & Meckstroth

[57] ABSTRACT

A wristwatch has a plurality of light emitting digital readout elements which are located along one end of the watch above the watchband. A hermetically sealed time capsule is enclosed within the watch case and includes an integrated circuit chip which divides the frequency output of a battery powered quartz crystal oscillator into a series of pulses which are counted and selectively interrogated to provide a series of electrical outputs corresponding to seconds, minutes, hours, days, months and years. The time capsule includes sealed control switches which are actuated by magnets slidably mounted on the case and which provide for selecting different outputs for visual display on the readout elements, corresponding to either hours and minutes, month and day or seconds. The electronic circuitry automatically compensates for 28, 30 and 31 day months as well as for leap years, and the readout may be selected for repetitive 12 hours or 24 hour display. When the 12 hour readout is selected, the AM/PM indicating light is energized when the hours and minutes readout is selected. A solar cell is positioned on the top surface of the watch case and functions to control the intensity of the readout elements according to the intensity of ambient light, as well as to recharge the batteries. The control switches also provide for setting the watch by either changing the minutes output while holding the seconds output at zero, or by changing the hours output without changing the minutes, seconds and days outputs, or by changing the days output without changing the seconds, minutes, hours and months outputs.

17 Claims, 28 Drawing Figures

45
70

R
R
77
OSC
DIVIDER
DIVIDER
SECONDS COUNTER
82
27
STROBE CONTROL LOGIC
S.C.V
W X Y Z
A B C D
SEC-UNITS
4 POLE 10 POSITION
222 OUTPUT
A B C D
DATE
TIME
20
20A
19
35
36
37
38
41
42
39 39
W
A B C D
a
b
c
d
e
f
g
BCD TO 7 BAR DISPLAY DECODER

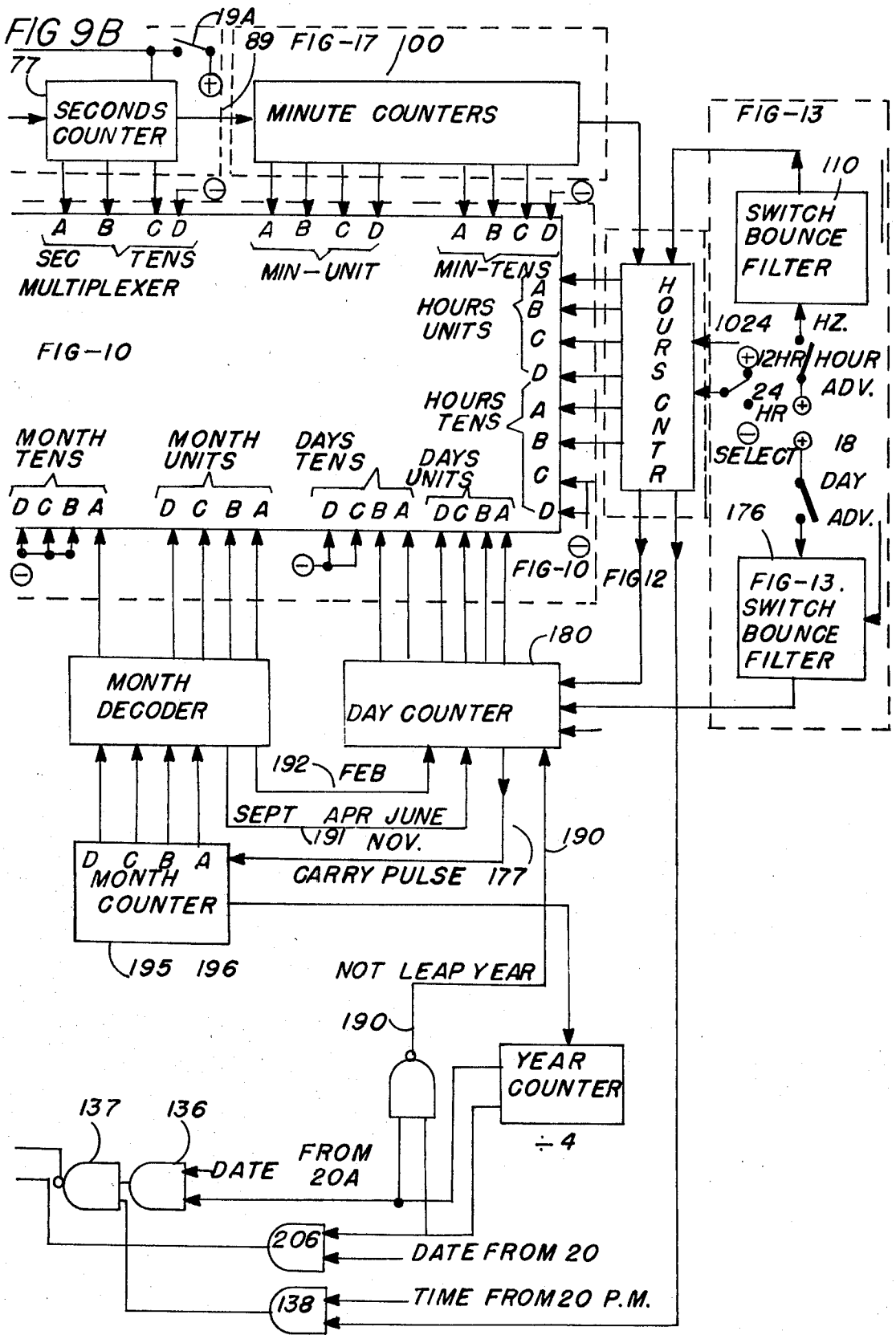
FIG 9B
19A
89
FIG-17
100
77
SECONDS COUNTER
MINUTE COUNTERS
FIG-13
110
SWITCH BOUNCE FILTER
A B C D
SEC TENS
MULTIPLEXER
A B C D
MIN-UNIT
A B C D
MIN-TENS
HOURS UNITS
HOURS TENS
FIG-10
HOURS CNTR
1024 HZ.
12HR
HOUR ADV.
24 HR
SELECT
18
DAY ADV.
176
MONTH TENS
MONTH UNITS
DAYS TENS
DAYS UNITS
D C B A
FIG-10
FIG 12
FIG-13. SWITCH BOUNCE FILTER
180
MONTH DECODER
DAY COUNTER
192
FEB
SEPT APR JUNE
191 NOV.
190
D C B A
MONTH COUNTER
CARRY PULSE 177
195 196
NOT LEAP YEAR
190
YEAR COUNTER
÷4
137
136
DATE
FROM 20A
206
DATE FROM 20
138
TIME FROM 20 P.M.

222
A
B
C
D
228
227
223
N N N N
226
229
W
A
B
HRS TENS
X 230
A
B
C
D
HRS UNIT
Y 231
A
B
C
MIN TENS
Z 232
A
B
C
D
MIN UNIT
SECONDS 233 TENS
Y
A
B
C
234 UNITS
Z
A
B
C
D
235
W
A MONTH TENS
X 236
A
B
C
D
MONTH UNITS
237
Y
A
B
DAYS TENS
Z 238
A
B
C
D
DAYS UNITS
240
TO FIG-15
241
224
20
TIME
20a
DATE
SEC.
19
225
N N N
239
256
512
1024
2048
221
249
245
246
250
128
64
W
30Ω
W
251
X
248
SCV
N
1024 256 512
128 128
N128
W 128
64
N 128
X
N
N Y 64
Y
252
Y
256
512
1024
S
C
V
64
N 128
N Z 128
Z
253
Z
247

| A | B | C | D | W | # | a | b | c | d | e | f | g |
|---|---|---|---|---|---|---|---|---|---|---|---|---|
| L | L | L | L | L | 0 | L | L | L | L | L | L | H |
| H | L | L | L | | 1 | H | L | L | H | H | H | H |
| L | H | L | L | | 2 | L | L | H | L | L | H | L |
| H | H | L | L | | 3 | L | L | L | L | H | H | L |
| L | L | H | L | | 4 | H | L | L | H | H | L | L |
| H | L | H | L | | 5 | L | H | L | L | H | L | L |
| L | H | H | L | | 6 | L | H | L | L | L | L | L |
| H | H | H | L | | 7 | L | L | L | H | H | H | H |
| L | L | L | H | | 8 | L | L | L | L | L | L | L |
| H | L | L | H | | 9 | L | L | L | L | H | L | L |
| L | L | L | L | H | 0 | H | H | H | H | H | H | H |

70
TO FIG 11
71
49
BINARY
FREQUENCY
DIVIDER
MULTIPLE
STAGES
PER

64 HZ
128 HZ
256 HZ
512 HZ
1024 HZ
2040 HZ
TO FIG 10
TO FIG. 11. 14. 12. 17.
45
28
OSCILLATOR
27
ISO DIODE
S.C.V
25
26
R
15

SOLID STATE ELECTRONIC TIMEPIECE

This is a division of application Ser. No. 139,468, filed May 3, 1971 which is now U.S. Pat. No. 3,823,551.

BACKGROUND OF THE INVENTION

There have been many proposals for solid state electronic wristwatches and clocks which employ bistable electronic counters to display the time. Commonly, the indicating or display means are located on the top of a wristwatch since this is the location which is conventional for the dial face and hand pointers of a mechanical watch. For example, in U.S. Pat. Nos. 3,427,797, 3,540,209, 3,258,906, 3,466,498, 3,509,715, 3,276,200, 3,485,033 and 3,505,804, continuous reference is made to the watch face as a synonym for the top of the watch. U.S. Pat. No. 3,194,003 shows a similar form of electronic timepiece.

Various means have also been suggested for setting the time on an electronic clock, but these means have the disadvantage that they mimic the action of the mechanical watch by continuing the time readout during setting. This continuing readout is difficult to set at exact synchronization with an actual time signal. That is, since time is passing while the adjustment is taking place, the operator must watch his readout and at the same time observe another clock whose seconds indication is in motion or listen for a time signal and hope to advance his readout to within a few seconds of the actual time, after the signal. U.S. Pat. Nos. 3,456,152 and 3,195,011 relate to electronic timepieces having this form of time setting.

Such time setting means also carry from the lower order counters into the higher order counters. This is not objectionable when carrying from minutes to hours, however, it would be annoying to have the trial and error pulses feed into the days and months and years counters of a calendar watch. This would require further cycling to bring the counters back into proper place after adjusting the lower order counters for time zone changes or timing correction. While calendar circuitry has been previously considered, most suggestions leave the resetting of the day at the first of each month up to the operator. Months counters, and especially one with leap year provisions, have been deemed impractical due to the difficulties encountered in displaying and adjusting the counters. It has also been assumed that the calendar circuitry requires additional readouts and associated additional wiring interconnections.

In other proposals of electronic wristwatches, it has been assumed that a continuous display is required. When using light emitting elements, however, a continuous display requires a prohibitive power supply, in view of the efficiency of known light producing elements and the size of a battery required within the present state of the art. Furthermore, separate electronic components, such as resistors and capacitors for noise and signal control, have been found necessary in previous work. In addition, separate connections from each readout element to the elctronics circuit required as many as 33 connections for a four digit seven segment display and decimal points.

SUMMARY OF THE INVENTION

The present invention is directed to an electronic timepiece which addresses all of the above problems and provides means for eliminating or minimizing them. In accordance with a preferred embodiment of the invention as described herein, many carefully selected methods and components are disclosed for achieving the functions which the invention performs. In general, the timepiece comprises integrated circuits which sustain and divide the oscillations from a quartz crystal to produce a one pulse per second timing source and which also count seconds, minutes, hours, days, months and years. The circuits then multiplex, select and distribute coded outputs from the counters to a decoder matrix which translates them into seven segment numeric readouts consisting of light emitting diodes in a four digit array which is time shared one digit at a time.

A two cell nickel-cadmium battery is connected to a solar cell array which maintains its charge from ambient light as a power source, and magnetically actuated reed switches provide for selecting readout functions and adjust timing. That is, three switches provide for selecting the time, in hours and minutes or in minutes and seconds and also for selecting the date, in day of month and month number for display on the readout. When neither time nor date is being selected, the readout is turned off to conserve power. Three other control switches provide for adjusting for time zones and for setting to the correct time. They advance the minutes, hours and day counters one step for each push of the switch.

The hour and day switches will recycle their respective counters repeadedly without carrying into the day or month counters to aid in preventing erroneous advances of the month and year counters. The minute advance switch advances the minutes counter one count for each actuation of the switch, and when the switch remains closed, the seconds counter remains at zero so that it can be released in synchronization with a time signal which occurs at an even minute. The time readout may be energized while the minutes advance switch is held closed so that the operator may observe the time signal indication which is being awaited.

The readout is mounted at the edge of the watch perpendicular to the top surface of the watch and above the point where the wristband is normally attached so that the display is in a natural wrist position when being viewed and so that ambient light from above will be partially shaded to prevent washout of the light emitting diodes. The edge location of the readout also provides for the maximum area on the top of the watch for receiving solar cells or to permit a case construction with a more solid top wall. The readout area is covered with a red color filter and circular polarizing material to maximize contrast ratio by minimizing reflected light.

The entire inside assembly is sealed by the case or by means of potting in a transparent plastic material to form a time capsule which is impervious to moisture and dirt. The only connections to the outside of the capsule are the light inputs and outputs and the magnetic fields for actuating the reed switches. The hours counter is arranged so that it can be simply altered from counting in twelve hour intervals to counting in 24 hour intervals, by connecting a single wire on the electronics enclosure to the positive or negative terminal of the power supply. When the watch is operated in a twelve hour cycle, a small indicating light is illuminated during the time display in the PM hours so that in adjusting for time zones, the operator will have a midnight reference to prevent date change at noon.

Connections are brought out of the electronics package to provide for sensing and setting leap year in the years counter. These leads are accessible to the technician only. When the date is displayed, the light used for PM indication is also used to indicate even years, and another light is provided to indicate that the even year is a leap year, thus indicating in binary form, the portion of the four year cycle that the calendar is in.

BRIEF DESCRIPTION OF FIGURES

FIGS. 9A, 9B and 9C taken together is a block diagram of the entire electronics for the wristwatch, and which is sectioned by dashed lines into areas that are covered in more detail by figures referred to thereon;

FIG. 9 shows the dynamic digital frequency divider circuit which is used in the counter dividers of FIGS. 11 and 16.

DESCRIPTION OF THE PREFERRED EMBODIMENT

Figure 2:
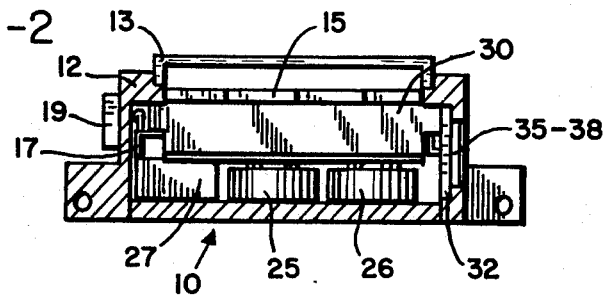
FIG. 2 is a section taken generally on line 2—2 of FIG. 1 and showing the relationship of the mechanical components.
Figure 1:
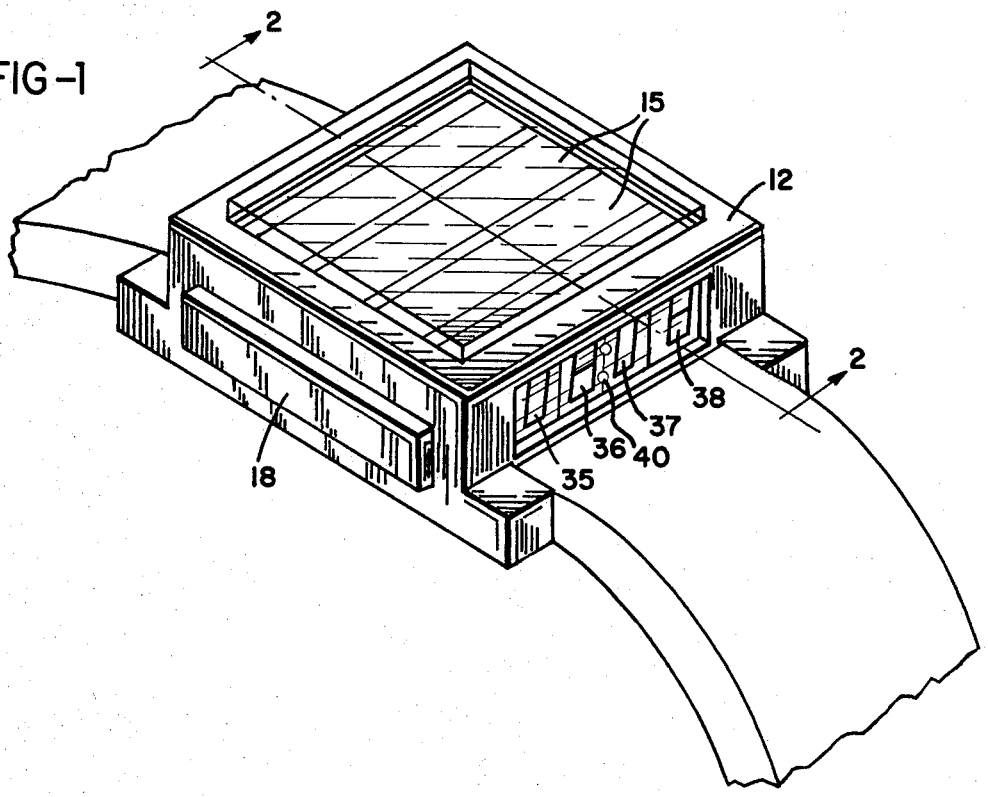
FIG. 1 is a perspective view of a wristwatch constructed in accordance with the invention and showing a portion of a wristband attached.
Figure 3:
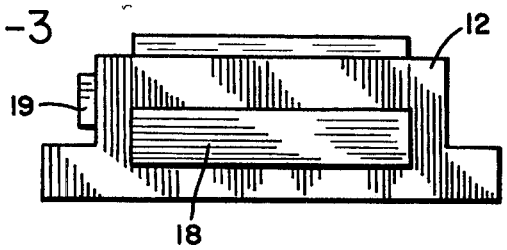
FIGS. 3–8 illustrate the left, right, rear, front, top and bottom views respectively of the wristwatch shown in FIGS. 1 and 2.
Figure 4:
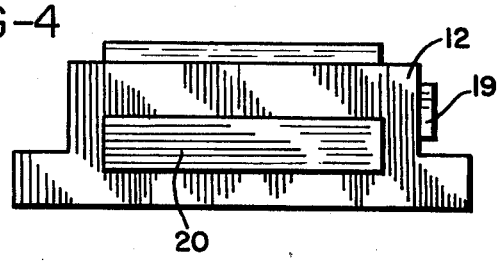
Figure 5:
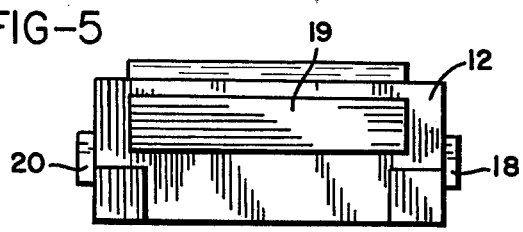

Referring now to the drawings which illustrate the preferred embodiment of the invention, and particularly to FIGS. 1 and 2, the entire inner components of the watch 10, are cast into a clear plastic block and then inserted into the wristwatch case 12 from the bottom side. There may be a secondary window 13 covering a silicon solar cell 15 at the top of the case, or the plastic encapsulation of the mechanism, may serve as this surface. Pairs of magnetically actuated reed switches 17 or Hall effect magneto-resistors are embedded in the plastic package and are activated by magnetic slide control buttons 18, 19 and 20 affixed in a track at the edges and rear edges of the wristwatch. Each slide button is centered by spring return and selectively activates one of the two magnetic switches by sliding forward or backward along the side of the case.

Nickel-cadmium sealed cells 25 and 26 are located at the bottom of the case 12 adjacent an enclosure for a quartz crystal 27. The electronic package 30 consists of a hermetically sealed ceramic block which contains the integrated circuits and driver transistors. The block also serves as a strong mounting surface for the silicon solar cells 15. The leads out the forward end of the package are attached to a circuit board 32 which holds the readout elements or modules 35–38. The leads out the rear of the package 30 connect to the power supply and the corresponding reed switches 17. The wristwatch case has a bottom cover 39 or may be opened to reduce the overall thickness of the watch by permitting the lower surface of the plastic block to form the bottom surface of the wristwatch.

Referring to FIG. 9, the readout modules 35–38 consist of four seven bar plus decimal point modules. These can be on a hybrid array substrate or may be purchased individually packaged. The colon indication 40 is accomplished by mounting the third digit from the left in an upside down position so that its decimal point forms the upper dot of the colon, and the decimal point of the preceding digit forms the lower dot of the colon.

Figure 6:
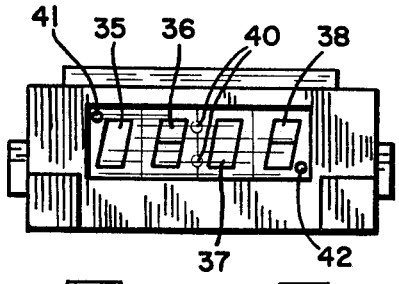
Figure 7:
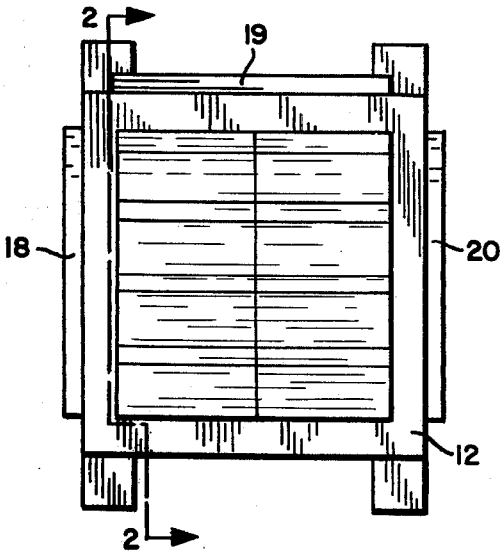
Figure 8:
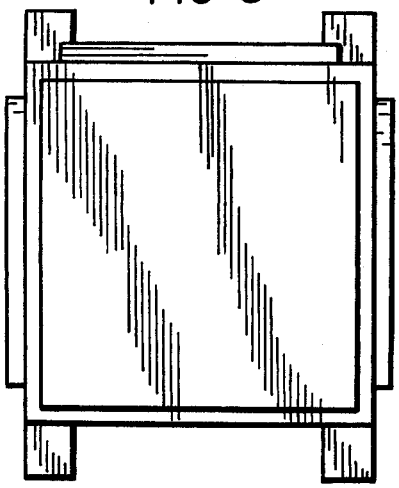

The module 35 (FIG. 6) is mounted upside down so that its decimal point 41 is located in the upper left-hand corner of the display. As will be explained later, this decimal point 41 and the decimal point 42 located at the right of the fourth module 38, are used to give a binary indication of the position of the years counter whenever the date is being displayed. The decimal point 41 on the fourth digit on the left 35 is also used to indicate the PM hours whenever the hours counter is set in the 12 hour counting mode and the time is being displayed.

The readout modules 35–38 consist of light emitting diodes which provide a matrix isolation which permits a multiplexing or time shared usage of the decoder which drives them so that the digits to be displayed are synchronously selected and positioned in the readout in a repetitive manner to produce the effect of continuous display. If the display were to consist of incandescent elements, separate diodes would have to be placed in series with them or the elements could be individually driven instead of commonly driven as shown in FIG. 9.

Figures 16, 19:
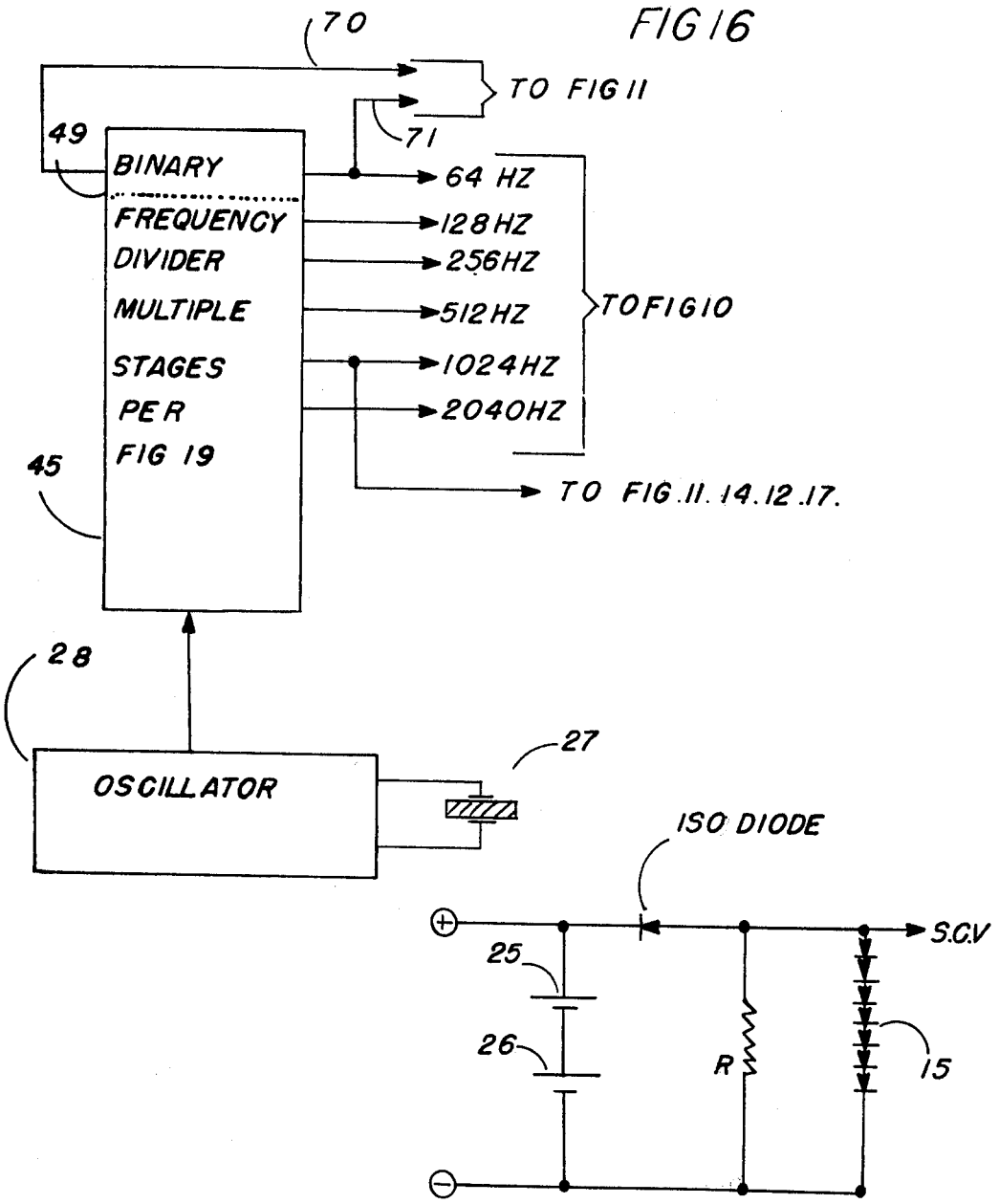

In FIG. 16, a quartz crystal 27 establishes the time base for the entire timepiece. In the preferred embodiment, this crystal is cut to oscillate at a frequency of 32.768 kHz. and connected in an oscillator circuit 28, the output of which is connected to a binary frequency divider 45. This divider has several outputs, the highest of which is 2048 Hz. The divider also has an output at 1024, 512, 256, 128 and 64 Hz. The exact frequency of quartz crystal 27 is relatively unimportant as long as it is an integral multiple of the 2048 Hz. signal required.

These output signals are used to develop strobing and timing signals as shown and described with reference to FIGS. 10 and 15. The 64 Hz. output signal is also divided by a plurality of counters which provide BCD (Binary Coded Decimal) output signals which represent time and date.

The frequency division down from crystal or tuning fork frequency to the 64 Hz. level is provided for by dynamic digital flip-flops 45 described in detail in FIG. 19. These flip-flops utilize a single phase clock provided by the output lines of the preceding stage and produce a single phase output on the Q and $\overline{Q}$ outputs which is divided by two. These flip-flops utilize ten integrated transistors of the P and N field effect type. Their advantage lies in the fact that commonly used digital dividers employ 16 transistors in order that they may be stable in both of their possible output states.

Figure 17B:
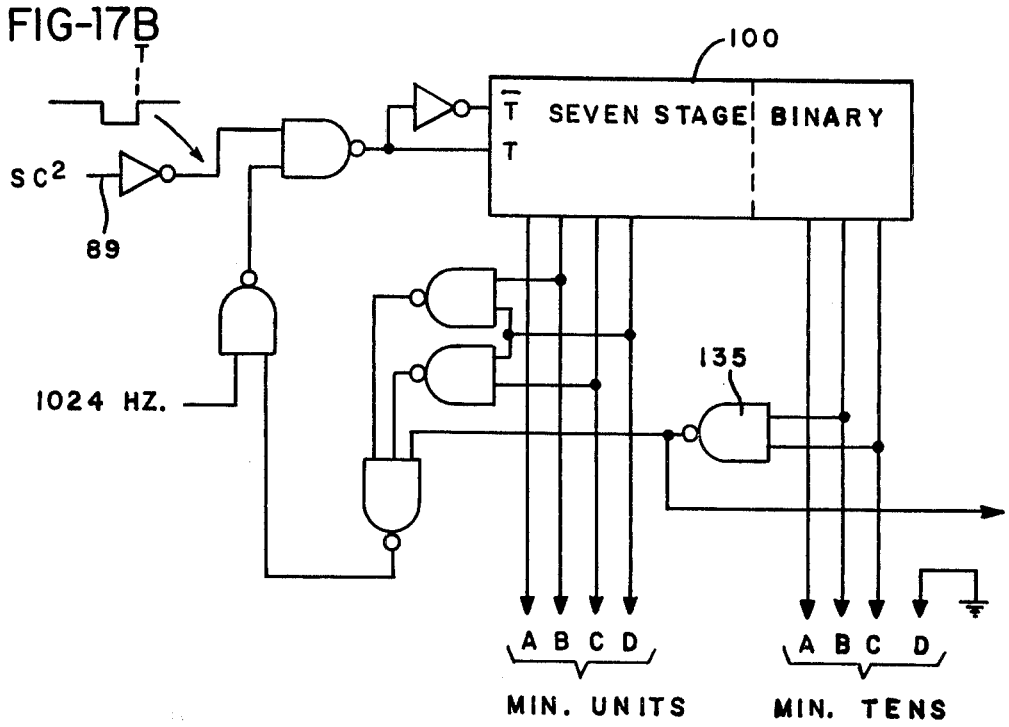
Figure 17A:
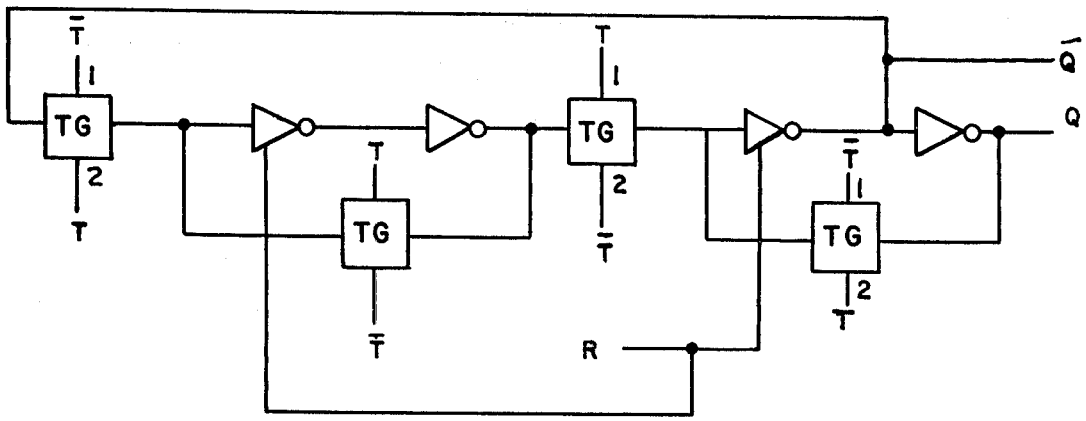

The normal divide by two arrangement is shown in FIG. 17A. It consists of two storage sections coupled one to the other in series by two transmission gates. The clocking phase of the transmission gates is arranged such that one section is storing while the other section is changing by feedback in an alternating manner such that for each clock alternation, the output stage changes one time thereby dividing by two. The conditions proceed statically one after the other as the clock transfers from one state to the other and there is no time constant requirement. This circuit requires sixteen transistors no matter how it is used.

Figure 19A:
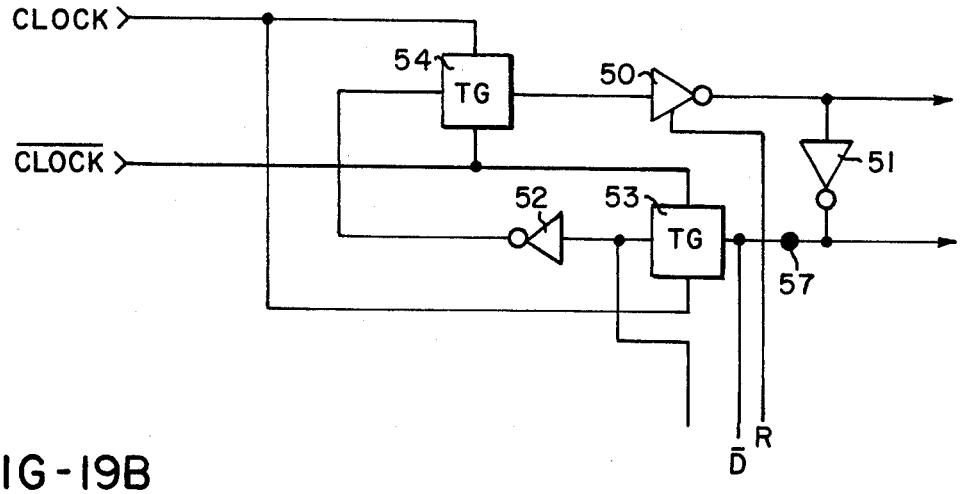

The dynamic digital divider of FIG. 19A requires only ten transistors and works in the following manner: Inverters 50 and 51 are connected in series and their outputs form the $\overline{Q}$ and Q outputs respectively. Inverter 52 adjusts to a state determined by the Q output through transmission gate 53 when clock is low. Transmission gate 54 is open when the clock is low thereby permitting the input to Inverter 50 to float at a static voltage roughly equal to what it was the last time that transmission gate 54 was closed connecting it to the output of Inverter 52.

The gate capacitance and the extremely high input impedance of the insulated gate field effect transistors used, permit this voltage to remain stable for a period determined by the open impedance of transmission gate 54. The opening of transmission gate 54 does not influence this voltage since the changing clock is coupled to it with roughly the same capacitance from each phase thereby producing a net zero influence at the transition point of the wave form. When the clock rises, transmission gate 54 closes the circuit from Inverter 52 output to Inverter 50 Input, and transmission gate 53 opens the circuit from Inverter 51 Output to Inverter 52 Input. The input to Inverter 52 floats at the potential last coupled to it from the Q Output Terminal. Transmission gate 53 opens fully before the new reverse charge from Inverter 52 Output can be fed to Inverter 50 input and ripple through to the Q terminal due to the transition delays of Inverters 50 and 51.

Therefore, the state of Q and $\overline{Q}$ reverse at the rise of the clock since the output of Inverter 52 is the reverse of the former state of Q and is now fed to the input of Inverter 50 which reinverts the $\overline{Q}$ to the state formerly held by Q whereupon Inverter 51 reverses the state of Q at a time slightly too late to influence the floating potential at the input to Inverter 52. When the clock falls, the state of Q and $\overline{Q}$ is preserved by the floating potential at the input of Inverter 50 because transmission gate 54 opens, a new state is switched to the input of Inverter 52 by transmission gate 53 which couples the new state of the Q terminal thereto. The output of Inverter 52 at this time reverses a little too late to influence the input to Inverter 50. Thus the output reverses once for each time the clock rises or, in other words, completes a whole cycle of two discrete states for each two such changes of the input clock thereby dividing by two.

Figure 19B:
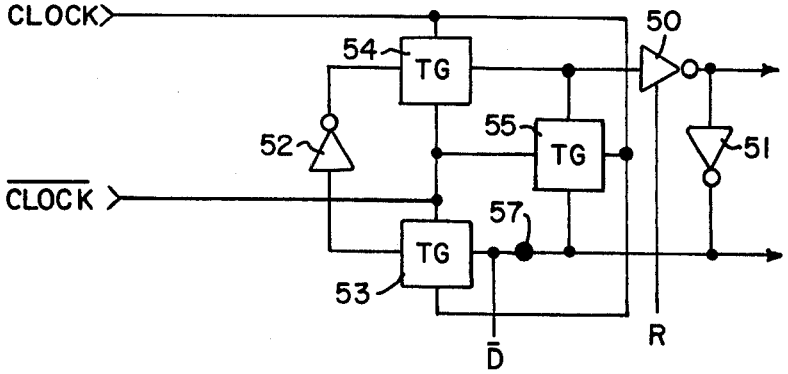

The semi-static version of this flip-flop shown in FIG. 19B is essentially the same except that an additional transmission gate 55 is installed from Q to the input of the $\overline{Q}$ Inverter thereby permitting any of the two states at the output to be permanently preserved when the clock is low. This arrangement utilizes two additional transistors for a total of twelve and still, in many applications, will serve as well as the sixteen transistor type previously required.

If the circuit in either flip-flop is broken at terminal 57, access to the device through the $\overline{D}$ input shown will permit operation as a data type flip-flop wherein the state of the $\overline{D}$ input is captured by the output of the unit at the rise of the clock and changes the $\overline{D}$ input other than at the transition moment of the clock have no effect at the output.

These two flip-flop arrangements require much less area for the active devices on the chip of an integrated circuit and, therefore, result in a cost savings in high volume production. It also has several other advantages. One is that the input clock signal must drive only half as many transmission gates as in the sixteen transistor flip-flop in the case of the basic divide-by-two stage thereby reducing capacitive loading of the incoming signal which, in turn, reduces the power dissipation required by the driving device. This has an advantage in higher frequency applications in power savings which is especially advantageous in a wristwatch permitting the use of higher quartz crystal frequencies in the oscillator at approximately the same power dissipation or reducing the power required for a given input frequency.

There is less power consumed in the transition of the inverters since there are only three of them instead of four, so the dissipation due to transition is reduced by a factor of 25%. This flip-flop will also work better the higher the input frequency is, due to load consideration factors and the inherent better float potential preservation on short duty cycles of the input to Inverters 50 and 52. This design should also provide for a higher total possible frequency of operation for a string of dividers at a given power supply voltage in that the first stage minimum operating speed is limited by the output capacitance that it must drive. With this configuration, the input capacity of the succeeding stage is less.

Figure 19C:
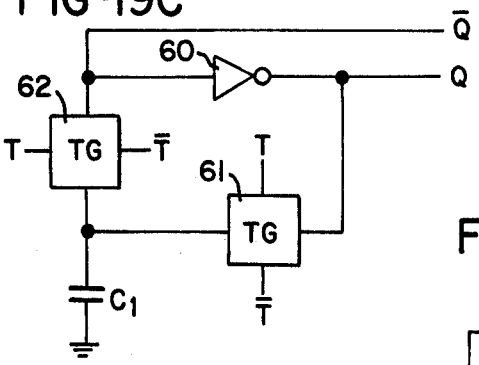

For slower operating frequencies, capacitance in the form of a larger gate electrode or metalization area over the substrate oxide pad, can be added at the inputs to Inverters 50 and 52 or a simpler flip-flop requiring only six transistors can be implemented using an integrated capacitor as shown in FIG. 19C. In this unit, the state of Inverter 60 output is fed to Capacitor C1 by transmission gate 61 when the clock is low. Transmission gate 62 is an open circuit permitting the input to Inverter 60 to store a floating potential which determines the Q output. When the clock rises, transmission gate 62 transfers the reversed phase to Inverter 60 input from the voltage stored on Capacitor C1 while transmission gate 61 opens to permit the voltage on C1 and the input of Inverter 60 to float together. With this circuit, Capacitor C1 must be significantly larger in capacity than the input capacitance of Inverter 60 or other devices attached to the $\overline{Q}$ output when summed.

An additional Inverter may be attached to the Q terminal to provide the $\overline{Q}$ function in cases where the ratio of capacitance of Capacitor C1 to the $\overline{Q}$ load and the input of Inverter 60 is going to dictate an excessively large value for C1. Essentially Capacitor C1 must be large enough so that when transmission gate 62 closes, the stored charge on the input of Inverter 60 does not become a major determining factor of the new voltage. If Capacitor C1 were equal to the gate input capacitance of Inverter 60, then the new voltage would be one-half of the supply voltage when transmission gate 62 closes. Therefore, C1 should be on the order of four or five times the gate input capacitance of Inverter 60 so that the voltage will not be at an indeterminate point of the transfer characteristic of Inverter 60.

Figures 9A, 11, 15:
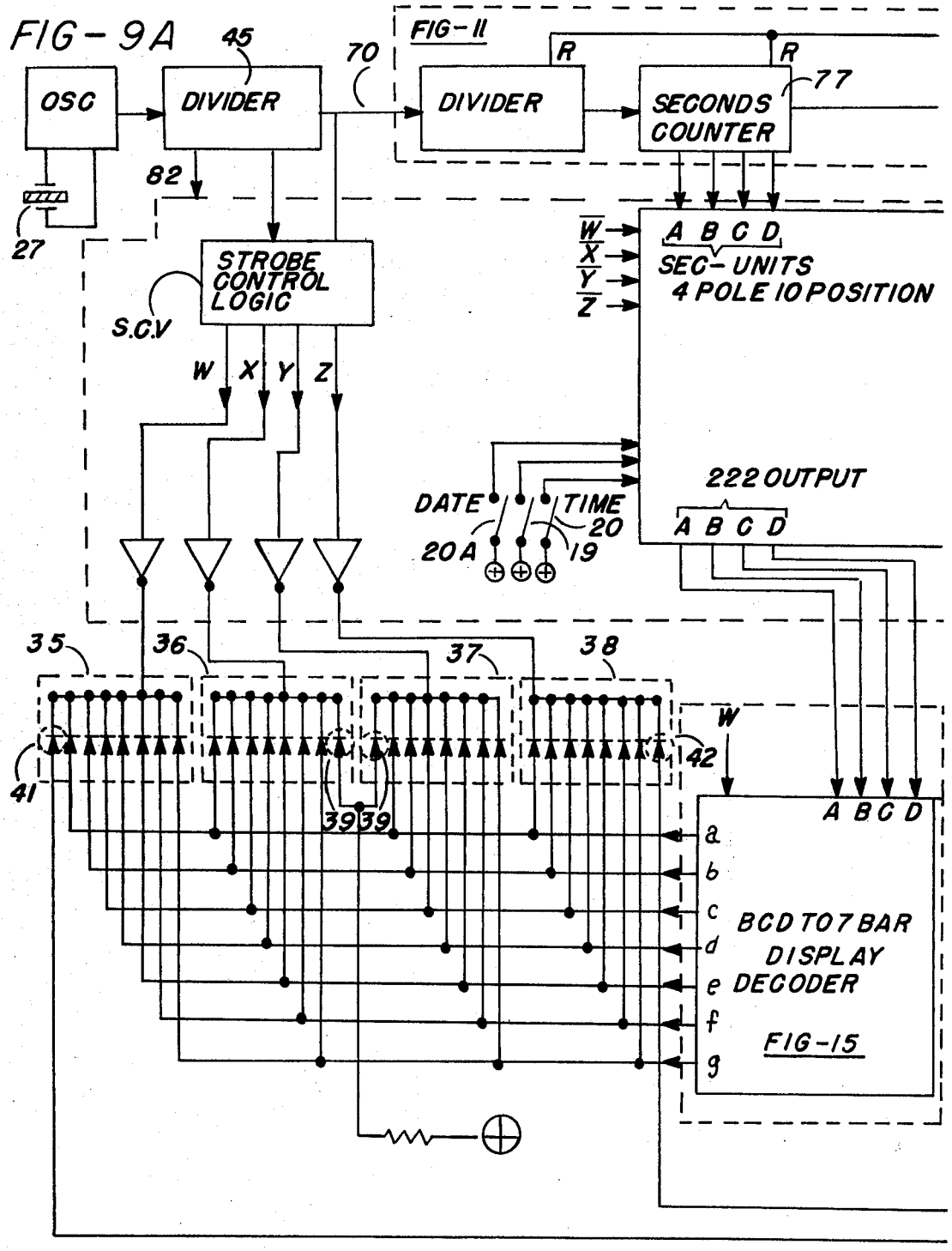

In FIG. 11, six dynamic divider stages 75 reduce this 64 Hz. signal to one pulse per second. This one pulse per second signal is fed into a seven-stage binary counter 77 which, beginning at the all zero state, counts until a binary ten is detected at NAND Gate 78. This trips NAND Gate 80 and enables NAND Gate 81 which admits high speed 1024 Hz. pulses into the input of the binary counter 77. This quickly advances the counter 77 through binary states Nos. 10 and 11 whereupon NAND Gate 83 detects binary 12 and by enablement through NAND Gate 80 into NAND Gate 81 permits the continuation of these fast pulses moving the binary counter quickly through binary states 12, 13, 14 and 15.

At the next pulse, the binary state of the first four stages is zero and the binary state of the fifth stage is one, yielding a BCD (Binary Coded Decimal) 10 output. NAND Gates 78 and 83 repeatedly exclude States 10–15 by quickly counting through them at the 1,024 Hz rate. This amounts to six pulses at 1,024 Hz., which therefore takes somewhat less than six milliseconds. This six milliseconds is significantly shorter than one second, therefore, it does not overlap the output pulse from the divider section 75 which caused the seven stage binary counter 77 to advance to the first of the undesired states (10) when it fell thereby permitting NAND Gate 85 to accept pulses from another source without interference for one-half second.

The quick advancing through the undesired states of this binary counter is also too fast to be noticed on the display and amounts to a very insignificant fraction of the totally displayed numeral. This procedure continues until binary 6 is detected by NAND Gate 86 in the last three stages of the binary counter. This enables NAND Gate 80 which, in turn, enables NAND Gate 81 to admit 1,024 Hz. pulses to the input of the counter. Since NAND Gate 86 detects both the 6 and binary 7 state of the last three stages it will continue to admit pulses until these three stages are returned to binary zero which, as it turns out, is coincident with the first four stages returning to binary zero due to the natural counting sequence of a binary counter.

In this way the units and tens binary coded decimal (BCD) outputs are generated for the seconds display of the wristwatch. These outputs are fed into the multiplexer section of FIG. 10. for distribution to the seven bar decoder and display elements 35–38. NAND Gate 86 also produces a negative going pulse on line 89 which begins at the time of the first undesired state in the last three stages and ends when the counter returns to zero. This is used as a pulse to advance the minutes counter.

In a hybrid version of the wristwatch using individual gate packages this may be an advantage to have a negative going output carry pulse. The actual carry connection in an integrated electronics package using a single monolithic array would utilize the Q and $\overline{Q}$ outputs of the seventh stage of counter 77.

This particular circuitry of stepping the counter through the undesired binary states can be implemented by using relay logic on a complementary symmetry metal oxide semi-conductor monolithic integrated circuit using fewer transistors than the normal feed-back gating system would permit for synchronous counters or counters that count in the actual BCD mode or scale while simultaneously providing a pulse type carry output when this is necessary or desired.

NOR Gate 90 detects whenever the counter is off the zero state or, in other words, when there is a logic one bit coming out of any of the stages of the counter. During any time, except the zero state, the reset switch 92 will enable NAND Gate 93 which, in turn, activates NAND Gate 80 and enables NAND Gate 81 to admit 1,024 Hz. pulses into the counter while the dynamic stages preceding are held at zero by a reset line also connected to this reset switch.

The switch 92 serves a dual purpose in that each time it is actuated it will advance the minutes counter one whole minute and can be used for making course corrections of the time indication. Normally less than a minute error will be found due to the high accuracy of the quartz crystal and tuning fork type oscillators. Therefore, one push of the button will advance the watch to the nearest whole minute and the operator may wait for the time signal to catch up with the new setting that he has just accomplished.

Setting the watch to a time several minutes before the actual indicated time, as far as the minutes and seconds counter is concerned, can be accomplished by repeatedly actuating this same switch so as to advance the minutes counter completely around through one hour until it reads the desired minutes indication.

Activating switch 92 also makes the counter advance through the remainder of its states until the zero state is reached whereupon the admittance of the 1,024 Hz. pulses is discontinued and thereby holding the seconds count at zero and completing one carry pulse on line 89 to the minutes counter thereby advancing it to the next minute indication. This switch also holds the dynamic stages at the zero count thereby reducing possible error in the release timing of this switch to one-half cycle of the 64 Hz. signal or 1/128 second. The purpose of this switch is for synchronizing the wristwatch with a time signal so that upon release of the switch the wristwatch beings to count seconds from a starting point of zero.

In the seconds counter 77, the primary purpose of this action is to provide a system which takes into account the switch bounces that may occur when the reset switch is closed. It will be noted by examination that the highest seconds indication would be 59 at the time that the switch might be closed. If the switch bounces and provides multiple pulses to NAND Gate 93, the counter will be stepped by these multiple pulses when the fast pulsed 1,024 Hz. source is high at the input to NAND Gate 81. The fact that it takes the counter a discrete number of pulses to scan back to the zero state, automatically allows for the timing required to assure that all switch bouncing has subsided before the end desired state is reached.

It has been shown by experimental work that the actual number of bounces to be expected from a magnetic reed switch of minature variety varies between four and sixteen. Even if all of these sixteen bounces occurred during such a short time as the 1,024 Hz signal is high, the counter could not be advanced more than sixteen discrete steps. Therefore, it will not overshoot the zero state since from the highest BCD output of 59 it takes at least 32 individual pulses to return the seven stage binary counter to zero. Therefore a digital switch bounce filter is accomplished without using external timing components such as resistors and capacitors and without the use of a digital clocked switch bounce filter which is employed elsewhere in this wristwatch.

Thus the complete switching system can be integrated as a purely active device circuit. Another method of accomplishing the same thing would be to install well known feed-back loops to make the counter count in the desired scale and to have the switch simply reset both the dynamic and static stages of the seconds section while activating a one-shot or monostable multivibrator which could be ORed in with the carry pulse output line. This would require some sort of timing and resistance capacitors network and implemented digitally requires at least two stages of binary division, one of which would have to be a clocked switch bounce filter so that the output would go through both an "On" state and an "Off" state before the catch was released so that the minutes counter would actually advance to the next whole minute and sit in that state in such a manner that the time display button of the wristwatch could be activated so that the time being held by this reset switch could be observed by the operator before he releases the switch.

Another advantage of this step around feed-back system wherein a faster pulse is admitted to quickly step around the undesired states is that the binary stages of division can be integrated in standard form with only their Q outputs brought out, eliminating the need for metalization connection to either the $\overline{Q}$, the data input or the reset terminals of the binary counter stages. This should result in a savings of integrated circuit chip space which will be important if employed on a system-wide basis especially as it reduces the metalization area requirements.

FIG. 17B shows the minutes counter section 100 of this wristwatch which employs seven standard static type flip-flops, such as shown in FIG. 17A, connected in cascade, to form a seven stage binary counter and undesired states are detected and quickly skipped over in a manner exactly like that of the seconds counter. In this case it is desirable that a single pulse carry be generated at the point of reset from 59 to zero minutes so that the carry pulse into the hours counter 120 will not hold the input of the hours counter in a state which would inhibit the entrance of pulses from the hours advance button which may be manually applied at any time at any state of the minutes counter. These manual advance input pulses are generated by the clocked, switch bounce filters 110 shown in FIG. 13. Without a pulse type carry from the minutes counter, this input, from the manual advance, might be inhibited during the 40 and 50 minute periods of the minutes counter.

An alternate method of accomplishing this would be to install exclusive OR Gate so that the input to the first counting stage of the hours counter would be phase inverted by each manual advance input pulse regardless of the state of the carry pulse or carry signal from the minutes counter. However, this would add to the complexity required to implement the function both directly and indirectly by complicating the further functional requirement that the manual hours advance pulses not advance the day counter in going through midnight.

Figure 12:
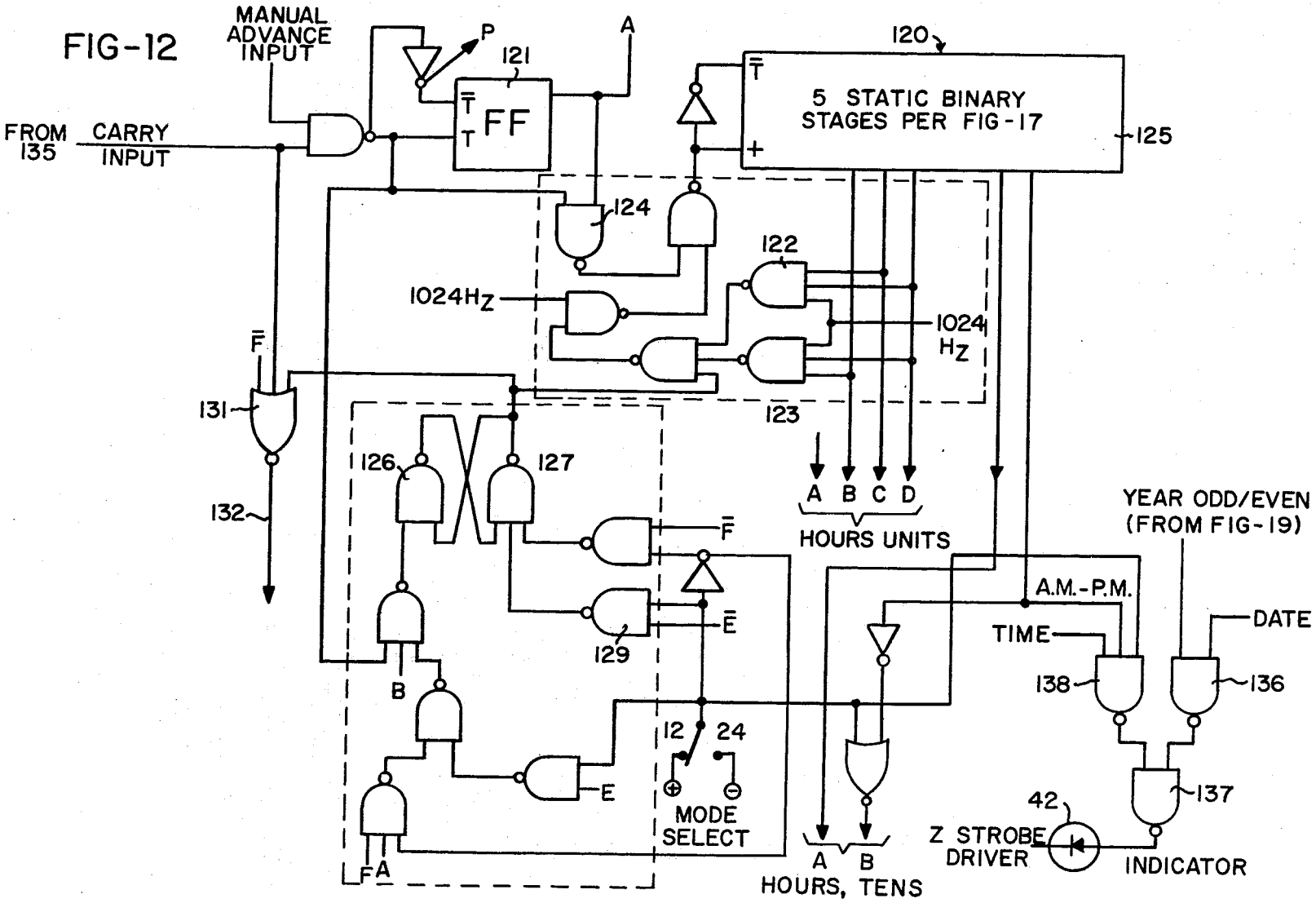

FIG. 12 shows the hours counter 120, of the wristwatch. The first counting stage 121 of this hours counter is allowed to alternate its states continuously without subjugation to the feed-back pulses. NAND Gates 122 and 123 detect the binary 10, 11, 12, 13, 14 and 15 states in counter 125 and enable the 1,024 Hz. signal to quickly step the counter around to zero whenever its first four stages are in a state higher than a BCD 9. The first counting stage 121, which controls the "A" line of the hours units indicator, is triggered to a new state at the end of the input carry pulse so that when A is high the input carry pulse is carried forward to the remaining five stages by NAND Gate 124 and at the end of the input carry pulse, the A line falls to zero thus obeying proper sequence for binary outputs A, B, C and D from counters 121 and 125.

This carrying system permits the A line to be high or low when an undesired state is detected by the feed-back system. This is required since this counter of hours is arranged to count in either a 12 or 24 hour mode as selected by a single exterior control line 128 which is connected to a plus for the 12 hour mode and a minus for the 24 mode and each mode reaches its first undesired state at a different state of counter 121. In other words, the 24 mode has a first undesired state which is a BCD 24 or an even number and the 12 hour mode has its first undesired state at BCD 13 which is an odd number. Therefore, line A of counter 121 is high for one and low for the other so for the 1,024 Hz. signal to occur, the carry signal from the A line must be of a pulse nature so as to be out of the way.

In this arrangement shown a latch consisting of NAND Gates 126 and 127 is used to turn on the 1,024 Hz. signal. It is tripped by the first undesired state as determined by the mode select switch and is shut back Off when the count reaches zero as defined by the same switch. In the case of the twelve hour count the latch is tripped by the main input carry pulse from the minutes counter when the output is a BCD 12 on lines A, B, C, D and E of counters 121 and 125. Line E controls the ones code of the BCD hours output for the tens of hours display. The twos output of the BCD code for the tens of hours display is held negative by NOR Gate No. 2 in the twelve counting mode. The latch is reset by NAND Gate 129 when line E falls to zero. Whenever line A of counter 121 is in the high state, during this procedure, reset is to a BCD 1 instead of zero. Line F of counter 125 is fed to the AM/PM indicator 41 when the time is being displayed so that the operator knows whether he is at an AM or PM hour when he is adjusting his watch for a time zone so that he will not leave it adjusted at such a point that the date counter will transfer at noon instead of midnight.

In the twenty-four hour mode a BCD 23 is detected and pulsed into the latch at the next main input carry pulse and the 1,024 Hz. signal steps the counter until the F line falls. This is synonymous with the zero state of the counter and provides the zero hour indication for midnight in a twentyfour hour clock system. The AM/PM indicator 41 is disabled in the 24 hour mode. NOR Gate 131 generates a date carry pulse on line 132 whenever the counter passes midnight due to an input pulse from the minutes counter. The F line insures that this will occur in the PM hours in the 12 hour count mode. The line connected to the minutes input gate 135 insures that it will not occur as the result of a manual advance input pulse.

Gate 136 illuminates the Z indicator decimal point 42 when the date is displayed and the years counter is at an even state in the 4 year leap year cycle of the calendar section of this wristwatch thereby supplying visual indication of the cycle state that the wristwatch is set to without external test connections being required. The other binary stage of the years counter is connected to the decimal point of the W strobe indicator to indicate the remaining bit of the binary information required to determine leap year cycle state when the date is being displayed.

FIGS. 13A–13D show the clocked switch bounce filter which is used to insure that each actuation of the hour advance or day advance button injects only one pulse into their respective counters. These switch bounce filters eliminate the need for RC timing networks and Form C contacts on the switch controls and/or multivibrator one-shot circuitry.

Figure 13A:
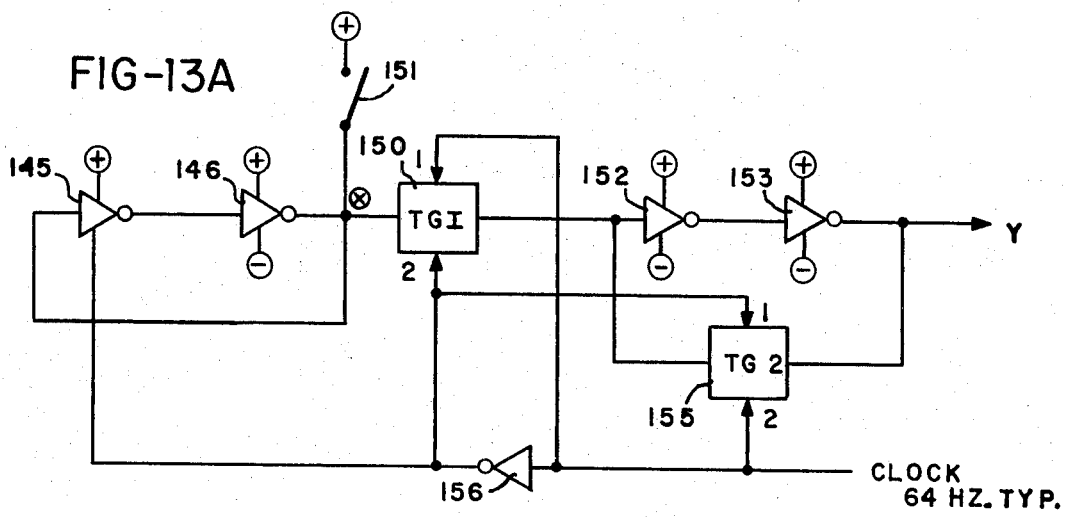

The diagram of FIG. 13A shows the logic of the clocked switch bounce filter employed in this wristwatch. The clock frequency used must be of a frequency which is low enough to insure that no more than one clock pulse rise can occur during the entire expected time constant of the switch bounce. In this way a D type flip-flop can be used to sample the input from the switch in such a manner that the output remains stable at the repetitive sampled input state. This insures that if the switch is sampled when it is bouncing it will surely not be sampled while it is still bouncing on the next clock pulse.

Therefore, regardless of the state at which the switch is in at the rise of the clock, the output will either remain as it was or change in accordance with the closed switch and subsequent clock pulses will result in either the same condition repeatedly sampled when the clock happened to catch the switch at the closed portion of its bounce or will be clocked to the new state on the next clock pulse after the bouncing contact time segment. In the particular implementation shown, Inverter 145 is forced to a positive output state when the clock is low thereby forcing a negative output state from Inverter 146. When the clock goes high Inverter 145 will maintain its positive output due to the negative feed-back from Inverter 146 output.

Transmission gate 150 is a through connection when the clock is high so that if, in the circuit shown in FIG. 13A, the switch 151 is activated during the time that the clock is high it will force the output of Inverter 146 to a positive state which will be inverted to a negative state by Inverter 145 thereafter insuring a positive state out of Inverter 146 in spite of the switch bouncing and this condition will immediately be transferred to the output through transmission gate 150 and Inverters 152 and 153.

When the clock falls transmission gate 150 is opened and transmission gate 155 becomes a through connection preserving the state of the output which existed when the clock fell. Inverter 145 is forced high in its output forcing Inverter 146 to try and go low. However, since during this time the switch bouncing will have subsided, the output of Inverter 146 is forced positive by the switch itself and when the clock goes high again this condition will continue to exist and Inverters 145 and 146 will rest in that particular state.

When the switch 151 is opened the next subsequent clock fall will reverse the output of Inverter 146 preparatory to the next clock rise which will transfer this new condition to the output through transmission gate 150. The advantage of this circuitry over a straight D flip-flop arrangement is that it does not require an integrated resistor outside of itself on the switch line and does not require as many transistors as a fully static D flip-flop. This switch resistor action, being clocked, results in less power lost than with a static ON transistor.

Transmission gate 155 may be eliminated if desired because transmission gate 150 may be considered as a sampling gate whose output is stored by the electrode capacitance of Inverter 152 input similar to the way that the dynamic digital divider operates. In this way, also, Inverter 153 may be eliminated depending on the phase of the input and the output desired thus reducing the number of transistors required to 8 whenever both phases of the clock are available and Inverter 156 is not required. If Inverter 156 is utilized to minimize the metalization conductors within a large scale integrated circuit we may also arrange that the clock signal has a short duty cycle in the low state so that the attempted negative transition of Inverter 146 when the output of Inverter 145 is forced high will be of a short duration with respect to time thereby reducing the effective power lost in the resistive conduction of Inverter 146 N type transistor which is attempting to ground Point X when the switch is closed thereby saving on the amount of power that is required to operate the circuit as compared to the ordinary implementation of a resistor passive pull-down arrangement.

Figure 13B:
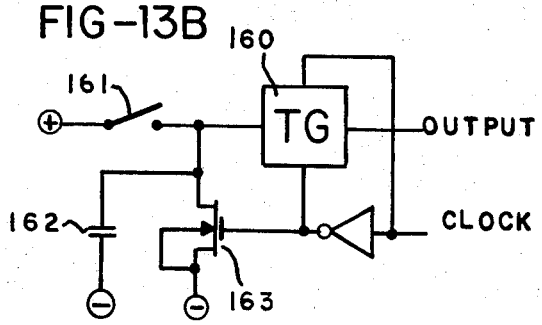

Further simplification of the same theory of operation is shown in FIG. 13B. In this arrangement transmission gate 160 samples the polarity of switch 161 when the clock is high and stores this polarity on the input gate capacitance 162 of the circuit which is going to be driven from this contact bounce eliminator. When the clock goes low, transmission gate 160 opens leaving the stored charge on the driven circuitry and the N type transistor 163 tries to pull the switch voltage output toward the negative end of the supply by turning ON. It can do this as the switch is bouncing, however, the bouncing will have subsided by the time that the clock rises again, such that when transmission gate 160 forms a through circuit, it will again see the same positive voltage coming from the switch. If the switch 161 is released, the next time that the clock falls the input to the transmission gate will be lowered by the N type transistor and then when the clock rises this new charge will be shifted to the driven circuitry provided that the integrated circuit capacitance 162 is greater than the driven circuitry input capacitance by a factor of 3 or 4 to 1.

Repeated pumping of the circuitry by the clock will, eventually, pump the input capacity of the driven circuitry down to the negative potential forced onto integrated capacitance 162 by transistor 163 thereby magnifying the apparent capacity of 162, perhaps even negating that it be required to be larger than the capacitance of the driven circuitry input.

Figure 13C:
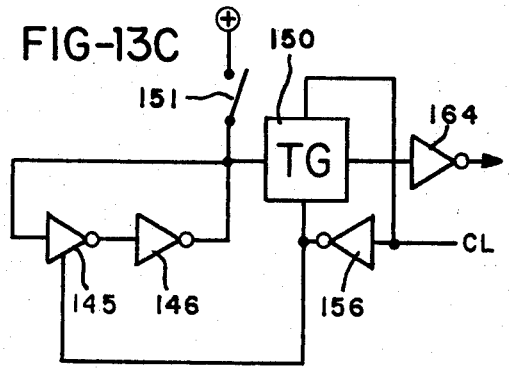

FIG. 13C may be the best all around implementation and retains its qualities even when Inverter 164 is eliminated.

Figure 13D:
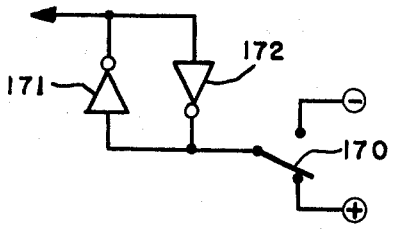

FIG. 13D shows a simplified two inverter flip-flop which may be commanded into one of two positions by a Form C switch 170. This switch forces the Inverters 171 and 172 into one state and then forces them back into the other state when the switch returns to its original position, thereby, eliminating switch contact bounce and dissipating nearly zero power in either position and requiring no resistor or capacitor and also having the advantage of a single lead coming out from the integrated circuit to the switch. The only disadvantage of this circuit is that Form C reed magnetic switches are considerably more expensive than the single contact type and a few additional transistors within the integrated circuit as shown in FIGS. 13A or 13C is a negligible additional cost on a large scale integrated circuit.

Figure 14:
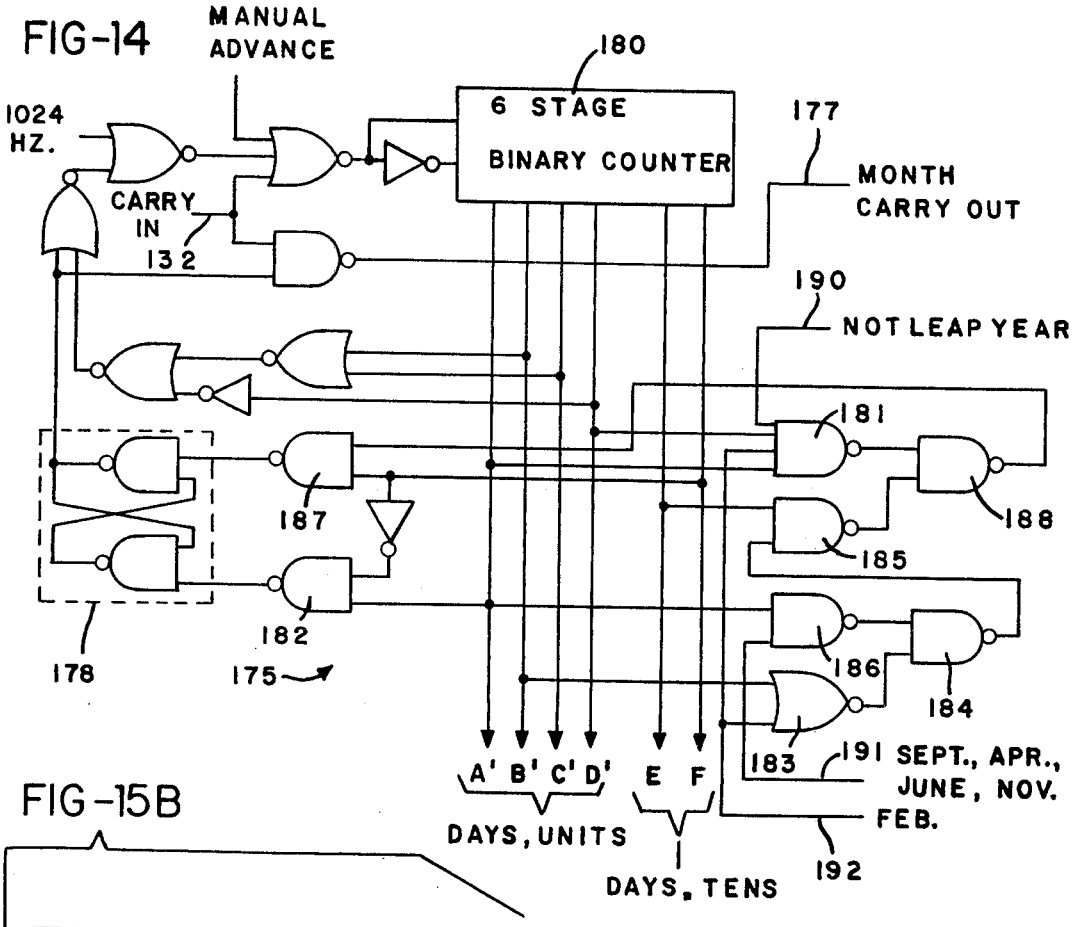

FIG. 14 shows the day counter 175 of the calendar section of the wristwatch. It steps ahead one day with each pulse from the hours counter on line 132 from carry gate 131 or from the day advance switch 18 through the bounce switch filter 176 (FIG. 9). In essence it operates in the same way as the minutes, seconds and hours counters insofar as it rejects the undesired states of an otherwise binary counter arrangement consisting of six stages. A carry output 177 is generated only by the carry input and reset such that the manual advance pulses from the switch 18 will not cause carry pulses to be generated into the months counter so that a person may recycle the days around past the end of the month to an earlier desired day indication, without advancing the month counter, which, if it happened, would then require that the advancing of the days be carried on until the entire four year cycle of the calendar section was gone through, or, would generate the requirement for an additional control switch to activate the month counter or the years counter.

Figure 18:
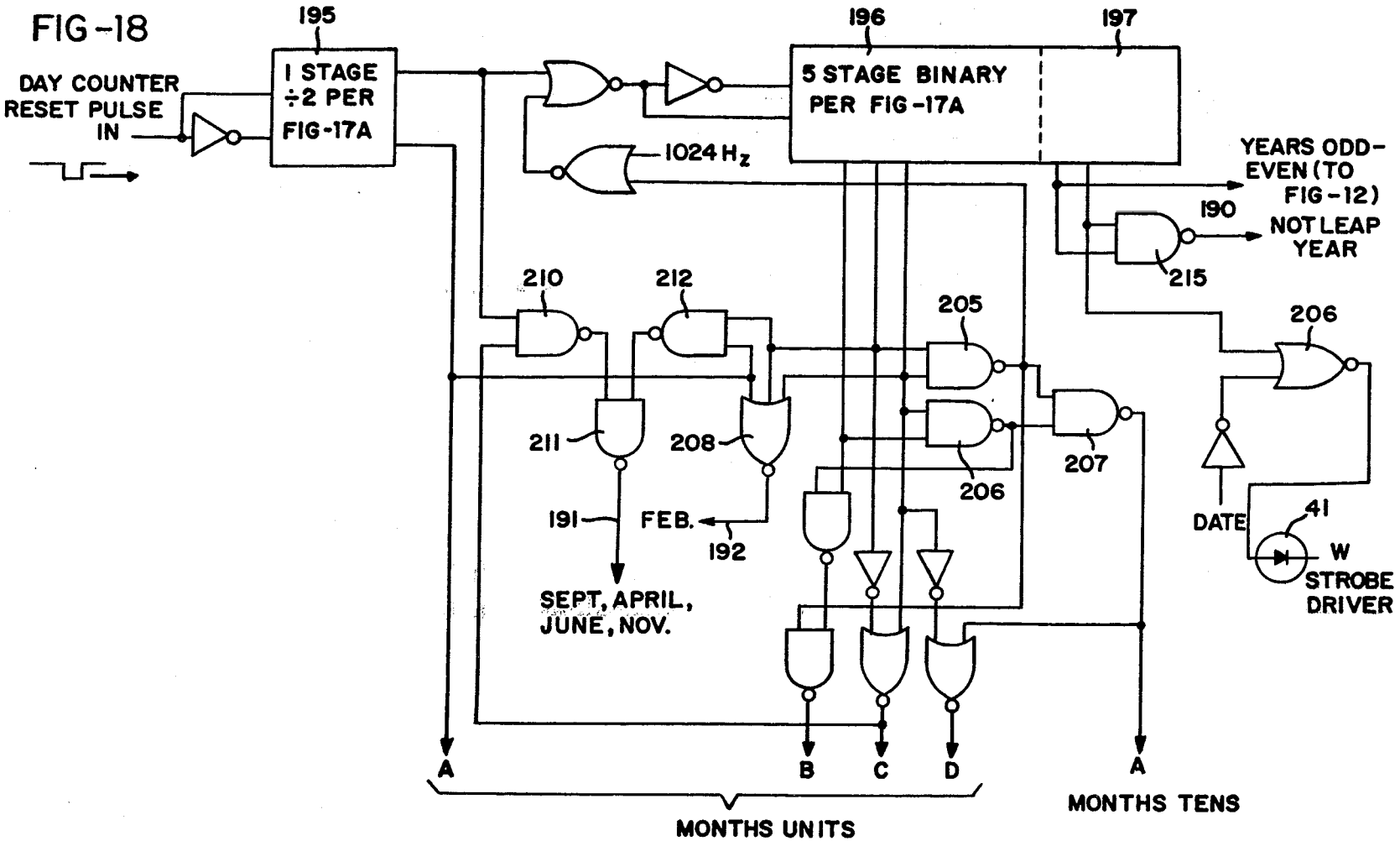

A latch 178 is used with detector gates to detect the first undesired state signifying the end of the month whereupon the latch trips and proceeds to enable gating which feeds in the 1,024 Hz. pulses until counter 180 reaches the first of the month position whereat the latch is reset by detection gating or logic terminating the admittance of the 1,024 Hz. pulses. There is a multiple detector which can detect the 29th, 30th, 31st, and 32nd BCD state of the counter output. Which one of these detections will occur is determined by inputs which feed back from the month counter (FIG. 18) and the four year leap year counter (FIG. 18). For example, when it is not leap year and it is February, NAND Gate 181 will detect the 29th of the month, trip the latch, thereby rejecting all states until the first of the month output resets the latch via NAND Gate 182.

If an output from Gate 181 is not forthcoming because of it being leap year then the February signal forced through NOR Gate 183 and NAND Gate 184 will appear at the input to NAND Gate 185 and trigger the latch 178 when the 30th position of BCD code is reached and all states are rejected until the first of the month is reached. If it is Sept., Apr., June or Nov., NAND Gate 186 will be enabled on the 31st and its output will be fed through NAND Gate 184 to NAND Gate 185 where it is ANDED with the 10 bit (line E) of the tens section of the counter 180 and subsequently ANDED by Gate 187 with the 20 bit (line F) of counter 180.

It will be noted that the 20 bit (line F) is required at NAND Gate 187 for any of these reset latch triggers to be generated. If none of the above conditions are met, the 32nd state of the BCD output will actuate NOR Gate 183 which feeds a signal through NAND Gate 184 to the input of NAND Gate 185 where it is ANDED with the 10 bit and sent through NAND Gate 188 to be ANDED with the 20 bit thereby activating NAND Gate 187 which trips the latch. This variable modulus counter system is implemented rather simply by using the step-around counter arrangement. The not-leap year signal 190 from the years counter and the September, April, June and November signal 191 from the months decoder and the February signal 192 from the months decoder insure that the day counter 180 will step around and generate a month counter advance carry pulse on line 177 at the proper number of elapsed days.

FIG. 18 shows the months counters 195, 196 and years counter 197 which employ six static binary counting stages. The first four stages recycle to generate binary 1 through 12 on lines A-D. The first stage simply alternates its state indefinitely. The zero state of the counter system is never reached since the months are numbered 1 through 12 and the zero state is not required and the code is more easily converted to a BCD output code by decoder 200. NAND Gates 205–206 and 207 generate the 10 bit of the tens BCD output for the month counter. NOR Gate 208 generates a signal whenever the counter is on Feb.

NAND Gates 210, 211 and 212 produce a signal on line 191 when the counter 195, 196 is on Sept., Apr., June or Nov. These outputs along with the not-leap year signal 190, decoded by NAND Gate 215, are fed back to the day counter 175 so that the day counter will reset at the proper number of days for that particular month. NOR. Gate 206 illuminates the years 2 bit indicator 41 which is the decimal point of the W strobed readout whenever the date is displayed.

The February signal 192 need not be generated on a single line as shown but may, instead, simply consist of three transistors substituted for each transistor in the days counter which is labeled for Feb. input in accordance with the logic required to implement the tree logic of that feed-back system thereby saving two additional transistors over direct substitution of the gate logic shown. Similar implementation of the Sept., Apr., June and Nov. signals and not-leap year signals may be implemented to save another two transistors each.

Figure 10:
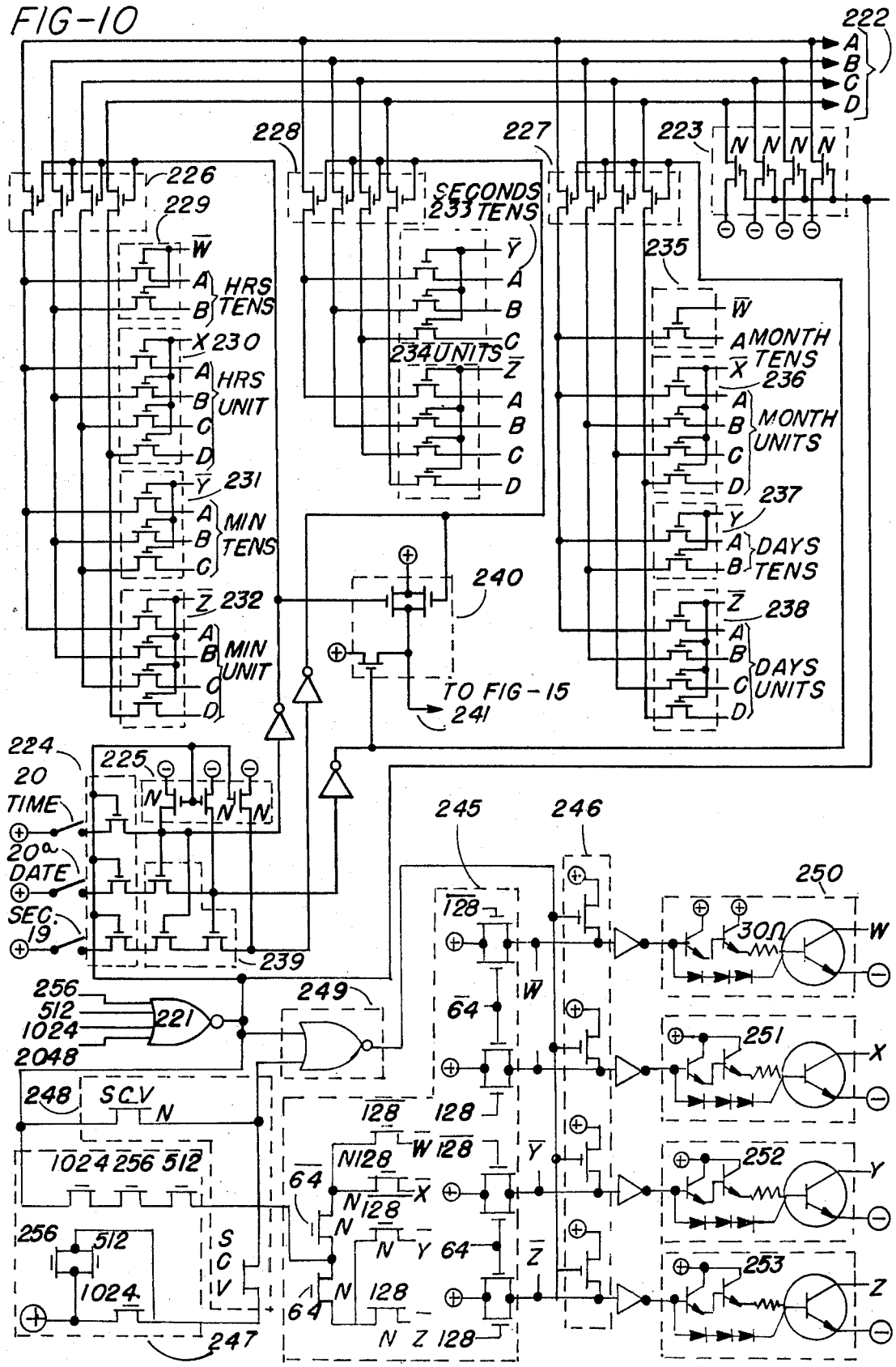
FIGS. 10–18 show the detailed electronic construction of the sections shown in the block diagram of FIG. 9.
Figure 11:
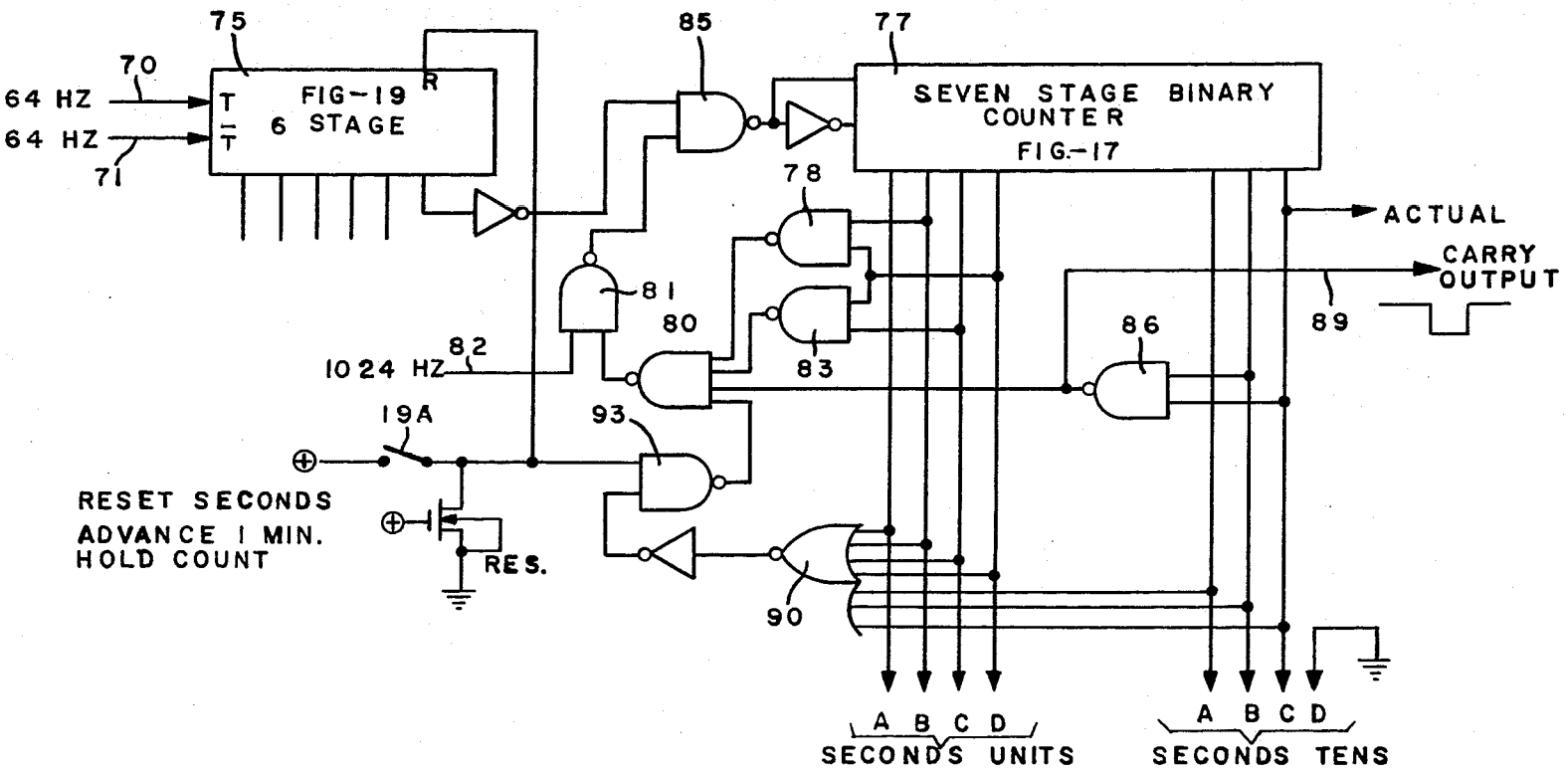

FIG. 10 shows the multiplexer and strobe signal generating sections of the timepiece. There are three display control switches 19, 20 and **20*a* which selectively control the application of seconds, time and date BCD signals to the input of the decoder section in FIG. 15.** The time switch permits display of the hours and minutes. The date switch permits display of the month and day or month. The seconds switch permits display of seconds on the Y and Z indicators.

NOR gate 221 generates a short duration pulse at the end of the W, X, Y and Z indicator strobe time frames. This pulse from NOR gate 221 restores the logic zero or negative output at the A, B, C and D output terminals, shown generally at 222, by means of a group of N type transistors 223. While this is being done, the display switch inputs are disabled by three P type transistors 224 and three N type transistors 225, so that the time, date and seconds selecting transistors 226, 227 and 228, respectively, will be open circuited from the A, B, C and D outputs 222.

P transistor groups 229–232 are sequentially turned on during the W, X, Y and Z time frames, respectively, so that the hours tens code, hours units code, minutes tens code and minutes units code are sequentially connected to the A, B, C, and D outputs 222 when P transistor group 226 is turned on by the time selector switch 20. Transistor groups 233 and 234 in conjunction with transistor group 228 perform a similar function when the seconds selector switch 19 is closed. Transistor groups 235–238, in conjunction with transistor group 227 perform the same function for the months and days counter outputs when the date selector switch **20*a*** is closed.

Transistor group 239 is used to establish priority of the time, date and seconds display switches so that contradictory signals cannot reach the A, B, C, and D outputs 222. This is done by switching off the date and seconds signals whenever the time switch 20 is closed and switching off the seconds signal whenever the date switch **20*a*** is closed.

Transistor group 240 is used to sense when any one of the selector switches 19, 20 or **20*a* is activated and develops a signal on line 241 to turn on the display amplifiers and the voltage sensing amplifier in the decoder section shown in FIG. 15.**

Transistor group 245 functions as a decoder operating from the 64 and 128 Hz. signals and establishes the four basic time frames within the repetition time of the 64 Hz. signal for the $\overline{W}$, $\overline{X}$, $\overline{Y}$, $\overline{Z}$ signals. Transistor group 246 forces the W, X, Y and Z signals to the zero state during the strobe output of NOR gate 221 or when the solar cell voltage line is low, and transistor group 247 is not disabling the solar cell voltage control transistor group 248. All of the foregoing conditions for transistors group 246 are sensed by NOR gate 249.

This multiplexing scheme not only provides the normal advantages of interconnection reduction but has the further advantage that it stores its negative output on the gate input capacitance of the circuitry which it drives so that only half as many transistors are required to connect the output of the multiplexer to the inputs from the various time keeping counters because only the positive state outputs of these counters must be transferred to the multiplexer A, B, C and D outputs 222. In a more conventional arrangement, a complementary group of N type transistors would be required to transfer the negative or zero state logic outputs of said time keeping counters to the A, B, C, D multiplexer outputs.

Transistor groups 250–253 are output drive circuits for the W, X, Y and Z strobe signals, respectively. Each incorporates a Darlington amplifier driving a 30 ohm resistor which is connected to the base of an output transistor. The forward intrinsic voltage drop of the three base emitter junctions insures that for battery voltages below 2.1 volts, the output transistor will be reverse biased and draw only leakage current from the power supply.

In a two cell, nickel-cadmium battery power supply, 2.1 volts is an output level indicating that sufficient stored power capacity has been used from the batteries that power consumption by the readout should be terminated in order to preserve the remaining capacity for use by the time keeping elements of the circuit. Thus, a battery capacity sensing circuit is included which reduces the readout intensity or drive level of the readout devices as the battery approaches 2.1 volts. The resistor in the base circuit of the output transistor sets the current drive level to the output transistor when the battery voltage is above 2.1 volts and may be adjusted to give any desired slope of the current output versus battery voltage above 2.1 volts. The three diodes shown are connected so that a current limiting occurs whenever the voltage drop across the resistor is sufficient when added to the intrinsic voltage drop of the first two transistor base emitter junctions to reach a total of 2.1 volts which is the forward intrinsic voltage drop of the three diodes. When the battery reaches a voltage of 2.8 volts (4 times 0.7 volts), the three diodes begin to conduct and limit the voltage drive to the first transistor. Thus the output current drive to the output transistor base is regulated at a constant current whenever the supply voltage exceeds 2.8 volts.

Whenever the solar cell output voltage is high enough to indicate high ambient light intensity, the N transistor of group 248 permits the duration of the W, X, Y, Z signals to be the full fraction of one fourth of the 64 Hz. signal repetition time. Whenever the solar celll voltage is low enough to turn off the N transistor and turn on the P transistor of group 248, transistor group 247 will limit the duration of the W, X, Y and Z signal to one eighth of their normal pulse width. This novel arrangement results in a pulse width limitation on the drive to the light emitting diode display for purposes of limiting power consumption when the timepiece is being operated in low ambient light conditions.

Figure 15B:
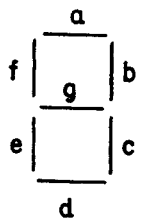
Figure 15B:
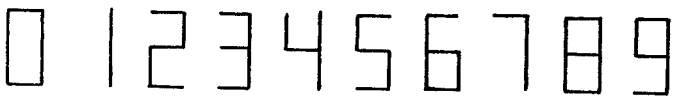
Figure 15:
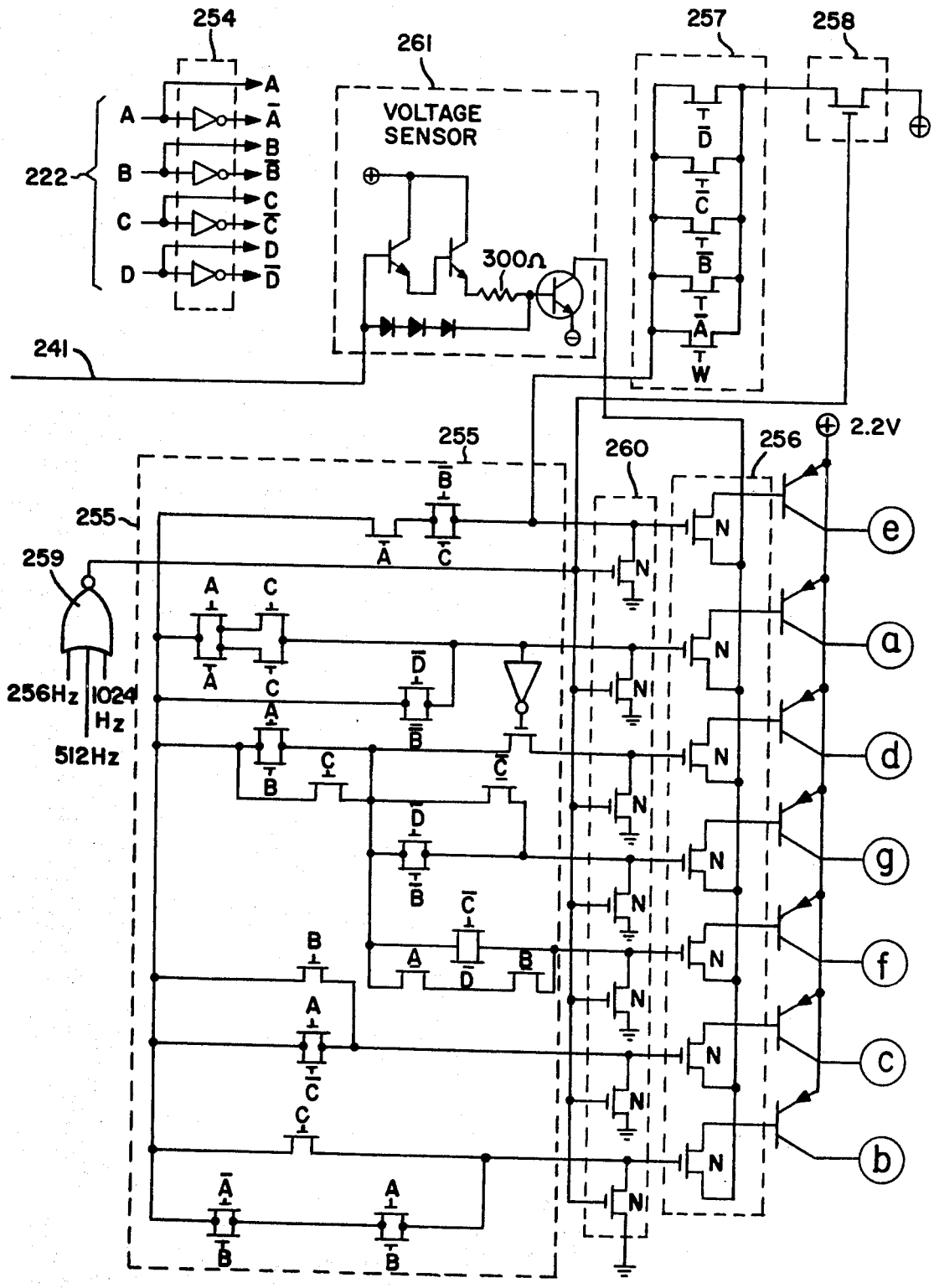

FIG. 15 is a decoder which converts the BCD output from the A, B, C, D four line input 222 into a seven bar digital indicator drive code. A truth table for this signal logic and the formation of the digits on the indicator is shown on FIG. 15B.

Inverter group 254 furnishes the opposite polarity signals of the A, B, C and D input lines for use in the decoder section. Transistor group 255 forms the bar segment decoding tree logic network. These are able to drive the gates of the output transistors in group 256 positive to turn on the segments *a–e* in accordance with the BCD code when transistor group 257 and transistor 258 are turned on. NOR gate 259 drives the gates of the output transistors 256 negative via transistor group 260. NOR gate 259 simultaneously turns off transistor 258. This signal from NOR gate 259 occurs at the beginning of the W, X, Y and Z time frames and is used to restore the negative logic output for outputs *a–e* so that during the remainder of the W, X, Y and Z time frames, transistor group 255 need only connect the positive logic outputs required for the particular digit being displayed, whereas a more common implementation would be to have a set of complementary transistors to group 255 to drive the outputs to the required negative states.

This negative state output referred to above is stored on the gate capacitance of output transistor group 256 after being established by transistor group 260.

Transistor group 257 disconnects the positive group output drive capability of the decoder whenever the input logic circuit is a decimal digit zero and the readout strobe system of FIG. 10 is in the W time frame so that most significant zeroes for the hours or months displayed are blanked for purposes of readout clarity and power conservation.

Voltage sensor component group 261 operates in identical fashion to output component group 250 on FIG. 10. It is turned on by line 241 which is activated by any of the display command switches and permits ground return for output drive transistor group 256 whenever the battery voltage is the 2.1 volts or higher, thus disconnecting the base drive current consumption when the battery capacity is too low to permit further display without using up battery capacity which should be reserved for the time keeping elements of the circuit.

Figure 20:
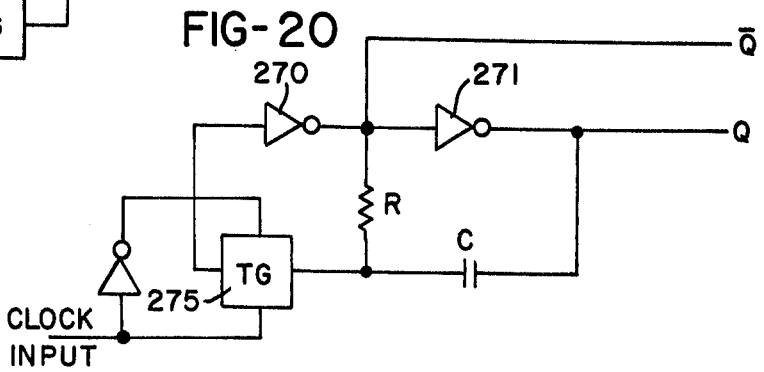
FIG. 20 is a circuit diagram of a synchronized astable divider.

FIG. 20 shows a synchronized astable divider. This unit operates in much the same manner as a normal astable multivibrator in that resistor R and C form a coupling network which permits the two Inverters 270 and 271 to be latched in one state or the other by capacitive coupling feedback until R is successful in discharging Capacitor C to the point where the process reverses and the capacitive coupling feed-back holds it in the opposite state while the voltage supplied to R reverses and it begins again to charge Capacitor C in the opposite direction. This process repeats indefinitely at a rate determined by the R and C values. If transmission gate 275 is inserted into the feed-back loop as shown and driven by a higher frequency clock signal, the gate 275 will act as a sampling gate stepping the voltage at the input to Inverter 270 along the RC charging curve until it finally succeeds in finding the final sample which will trigger Inverter 270 and reverse the latched condition of the flip-flop. The capacitance of the input circuit of Inverter 270 stores the sampled voltage during those periods when the transmission gate 275 is open.

For maximum stability, the astable portion of the circuit is set up so that it oscillates naturally at a frequency slightly higher than the output division frequency desired. This is arranged so that the final sampling gate trigger will find a voltage which has already crossed the trigger point for Inverter 270 by a significant margin while the gate was open circuited. Thus, the output from Inverter 271 will change simultaneously with the leading edge of the input clock pulse.

Further enhancement of the stability can be achieved by changing the duty cycle of the input frequency such that it opens the transmission gate circuit for longer than it is closed thereby reducing the sampling period and allowing more time for the RC network to cross the trigger voltage for Inverter 270. In this manner single stage frequency division of up to 200 to 1 may be reliably achieved with present methods of integrating the complementary symmetry MOS circuitry.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. An electronic solid-state timepiece adapted for use as a wrist watch comprising means for generating electrical pulses at a constant predetermined frequency, battery means for supplying power to said generating means, means for counting said pulses and for producing a plurality of electrical time outputs corresponding to at least hours and minutes, electro-optical digital readout means for producing a visual display of selected said outputs from said counting means, a solar cell connected to recharge said battery means, means including a control element for selectively connecting said time outputs of said counting means to said digital readout means, a substantially water and air impervious encasing material surrounding and supporting said battery means, said pulse generating means, said counting means, said readout means, said solar cell and said control element to form a durable fluid-tight time capsule, said encasing material being capable of transmitting light in areas adjacent said solar cell and said readout means, and means disposed outboard of said time capsule for remotely activating said control element within said time capsule by producing a field acting through said encasing material.

2. An electronic solid-state timepiece adapted for use as a wrist watch comprising means for generating electrical pulses at a constant predetermined frequency, battery means for supplying power to said generating means, means for counting said pulses and for producing a plurality of electrical time outputs corresponding to at least hours and minutes, electro-optical digital readout means for producing a visual display of selected said outputs from said counting means, a solar cell connected to recharge said battery means, means including magnetically actuated switch means for selectively connecting said time outputs of said counting means to said digital readout means, a substantially water and air impervious potting material encasing said battery means, said pulse generating means, said counting means, said readout means, said solar cell and said switch means to form a durable fluid-tight time capsule, said potting material being capable of transmitting light in areas adjacent said solar cell and said readout means, and a magnetic actuator supported outboard of said time capsule for relative movement and effective to actuate said switch means, within said time capsule.

3. An electronic solid-state wrist watch comprising means for generating electrical pulses at a constant predetermined frequency, battery means for supplying power to said generating means, means for counting said pulses and for producing a plurality of electrical time outputs corresponding to at least hours and minutes, electro-optical digital readout means for producing a visual display of selected said outputs from said counting means, a solar cell connected to recharge said battery means, means including magnetically actuated switch means for selectively connecting said time outputs of said counting means to said digital readout means, a substantially water and air impervious potting material encasing said battery means, said pulse generating means, said counting means, said readout means, said solar cell and said switch means to form a durable fluid-tight time-capsule, a rigid watch case defining an open bottom chamber, said time capsule being disposed within said chamber and having a bottom surface adapted to rest on a wearer's wrist, said potting material being capable of transmitting light in areas adjacent said solar cell and said readout means, and a magnetic actuator supported outboard of said time capsule for relative movement and effective to actuate said switch means, within said time capsule.

4. An electronic timepiece as defined in claim 2 wherein said counting means is effective to produce a plurality of electrical days outputs corresponding to at least days, and said means including magnetically actuated switch means are effective to connect said days outputs of said counting means to said digital readout means.

5. An electronic timepiece as defined in claim 2 including control means for changing the days output of said counting means without changing the minutes and hours outputs of said counting means to facilitate setting the timepiece.

6. An electronic timepiece as defined in claim 4 including control means for changing the days output of said counting means through the end of a month without changing the months output of said counting means to facilitate setting the timepiece.

7. An electronic timepiece as defined in claim 4 including control means for changing the hours output of said counting means through midnight without changing the days output of said counting means to facilitate setting the timepiece.

8. An electronic timepiece as defined in claim 4 wherein said counting means produce an electrical output corresponding to each year of a four year cycle, and electro-optical display means for visually displaying the years output of said counting means.

9. An electronic timepiece as defined in claim 1 including control means for selecting between repetitive twelve hour and twenty-four hour displays on said readout means.

10. An electronic timepiece as defined in claim 1 including means for sensing when said power supplying means drops below a predetermined capacity, and means responsive to said sensing means for disconnecting said readout means from said power supplying means below said capacity for conserving said power supplying means for said pulse generating means and said counting means in preference to further consumption of power by said readout means when said switch means is actuated.

11. An electronic timepiece as defined in claim 1 wherein said counting means includes an electrical AM/PM output for distinguishing between AM and PM of the hours output, and electro-optical readout means for visually displaying said AM/PM output.

12. An electronic timepiece as defined in claim 2 and including means for resetting said counting and comprising a second magnetically actuated switch capable of generating pulse, clock means for supplying additional pulses to said counting means, said clock means being connected to said counting means through said second switch, said counting means requiring a plurality of pulses from said clock means in excess of the number of pulses generated by said second switch due to contact bounce when said second switch is initially closed in order to reset to a predetermined state.

13. An electronic timepiece as defined in claim 1 wherein said counting means includes at least one astable multivibrator having an input, an output and a feedback circuit connecting said output to said input, said output of said multivibrator being used to produce at least one of said time outputs, a transmission gate connected to interrupt the connection between said feedback circuit and said input for synchronizing the transition of said multivibrator output with said pulse generating means, said transmission gate being opened and closed in synchronism with said pulse generating means, said multivibrator having a natural frequency of oscillation whereby it will transition from one state to another, and said frequency being adjusted to be slightly higher than a whole integer division of the frequency of said pulse generating means whereby said multivibrator will transition at the leading edge of that input pulse which represents an integer multiple of said multivibratory frequency.

14. An electronic timepiece as defined in claim 1 wherein said means for selectively connecting said time outputs to said digital readout means includes a plurality of elements each having means to store at least temporarily a voltage representing a selected logic condition, means for providing said voltage representing said selected logic condition to all of said elements, means responsive to said counting means for changing the logic condition of selected said elements, and means for interrogating the logic condition of each of said elements to provide said visual display.

15. An electronic timepiece as defined in claim 1 wherein said means for selectively connecting said time outputs to said digital readout means includes a multiplexer having a plurality of inputs from said counting means and outputs to said display readout means, a timing circuit for selectively and repeatedly activating said display readout means on a time shared basis simultaneously with the selection of said inputs to said mutliplexer for minmizing the number of output lines to display said time outputs.

16. The timepiece of claim 15 wherein said timing circuit operates at a repetition rate fast enough to create the visual illusion of a continuous display.

17. An electronic timepiece as defined in claim 1 wherein at least one of said counting means comprise a binary counter having an input connected to said pulse generating means and an output connected to a decoder circuit which detects the undesired states of said counting means for rejecting the same, means for supplying input pulses to said counting means at a frequency higher than said input pulses from said pulse generating means by an amount sufficient to advance said binary counter to a desired state in the interval between said input pulses from said pulse generating means.

* * * * *